US011512935B2

(12) United States Patent
Carbone et al.

(10) Patent No.: US 11,512,935 B2
(45) Date of Patent: Nov. 29, 2022

(54) EXTENDED RANGE BULLET

(71) Applicant: Vista Outdoor Operations LLC, Anoka, MN (US)

(72) Inventors: Justin A. Carbone, Anoka, MN (US); Jared Kutney, Cambridge, MN (US); Shawn Fitzsimonds, St. Francis, MN (US); Lawrence P. Head, Cambridge, MN (US); Bryan Peterson, Isanti, MN (US); Richard Hurt, Clearlake, MN (US); Joel J. Foley, Lewiston, ID (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/897,833

(22) Filed: Jun. 10, 2020

(65) Prior Publication Data

US 2021/0055086 A1 Feb. 25, 2021

Related U.S. Application Data

(63) Continuation of application No. 15/870,769, filed on Jan. 12, 2018, now Pat. No. 10,690,463.

(Continued)

(51) Int. Cl.

| | |
|---|---|
| ***F42B 10/44*** | (2006.01) |
| ***F42B 12/34*** | (2006.01) |
| ***F42B 10/46*** | (2006.01) |

(52) U.S. Cl.

CPC ..... *F42B 10/44* (2013.01); *F42B 10/46* (2013.01); *F42B 12/34* (2013.01)

(58) Field of Classification Search

CPC ..... F42B 10/22; F42B 10/42; F42B 10/44; F42B 12/34

See application file for complete search history.

(56) References Cited

U.S. PATENT DOCUMENTS

| | | | |
|---|---|---|---|
| 1,080,974 | A | 12/1913 | Johnson |
| 1,135,357 | A | 4/1915 | Clyne |

(Continued)

FOREIGN PATENT DOCUMENTS

| | | |
|---|---|---|
| GB | 190622505 A | 5/1907 |
| WO | 01/18483 | 3/2001 |

OTHER PUBLICATIONS https://www.nammo.com/product/our-products/ammunition/small-caliberammunition/7-62mm-series/7-62-mm-x-51-armor-piercing-8-m993/. Date accessed: Dec. 13, 2021.

(Continued)

*Primary Examiner* — J. Woodrow Eldred

(74) *Attorney, Agent, or Firm* — Reed Smith LLP; Matthew P. Frederick; John M. Cogill

(57) ABSTRACT

A cartridge with an expanding bullet that has advantageous terminal effects over an extended range. The expanding bullet including a bullet body including a metal jacket extending from a tail portion to a nose portion and surrounding an interior solid core and defining a forward opening and interior cavity. A tip has an exterior surface substantially flush with an exterior surface of the metal jacket. The tip has a main portion forward of the opening and a tip retention portion that at least partially fills the interior cavity. In certain embodiments the tip retention portion includes one or more fluid entry facilitation means such as a fracture regions configured to, upon impact of the bullet with a target, fracture or deform to expose one or more fluid pathways into the interior cavity and to a forward facing interior surface for initiating expansion of the expanding bullet.

20 Claims, 31 Drawing Sheets

Related U.S. Application Data

(60) Provisional application No. 62/518,334, filed on Jun. 12, 2017, provisional application No. 62/445,697, filed on Jan. 12, 2017.

(56) References Cited

U.S. PATENT DOCUMENTS

| | | | | |
|---|---|---|---|---|
| 1,328,334 | A | 1/1920 | Newton | |
| 1,493,614 | A | 5/1924 | Dickerman | |
| 1,967,416 | A | 7/1934 | Leussler | |
| 3,074,344 | A | 1/1963 | Devaux | |
| 3,881,421 | A | 5/1975 | Burczynski | |
| 4,044,685 | A | 8/1977 | Avcin | |
| 4,108,074 | A | 8/1978 | Billing, Jr. et al. | |
| 4,245,557 | A | 1/1981 | Knappworst et al. | |
| 4,655,140 | A | 4/1987 | Schirneker | |
| 4,685,397 | A | 8/1987 | Schirneker | |
| 5,127,332 | A | 7/1992 | Corzine et al. | |
| 5,259,320 | A | 11/1993 | Brooks | |
| 5,454,325 | A | 10/1995 | LeBlank | |
| 5,565,649 | A | 10/1996 | Tougeron et al. | |
| 6,070,532 | A | 6/2000 | Halverson | |
| 6,317,946 | B1 | 11/2001 | Beal | |
| 6,526,893 | B2 | 3/2003 | May et al. | |
| 6,546,875 | B2 | 4/2003 | Vaughn et al. | |
| 6,675,718 | B1 | 1/2004 | Parker | |
| 7,380,502 | B2 | 6/2008 | Emary | |
| 7,913,626 | B1 | 3/2011 | Reinhardt et al. | |
| 8,186,277 | B1 | 5/2012 | King | |
| 8,393,273 | B2 | 3/2013 | Weeks et al. | |
| 10,690,463 | B2 * | 6/2020 | Carbone | F42B 10/46 |
| 2004/0089186 | A1 | 5/2004 | Brygdes-Price | |
| 2007/0204758 | A1 * | 9/2007 | Spatz | F42B 12/74 102/514 |
| 2011/0252999 | A1 | 10/2011 | Carlson et al. | |
| 2012/0216700 | A1 | 8/2012 | Dennison | |
| 2014/0202351 | A1 | 7/2014 | Muskat | |
| 2016/0356584 | A1 | 12/2016 | Monroe et al. | |
| 2016/0377399 | A1 | 12/2016 | Burrow | |

OTHER PUBLICATIONS https://cuttingedgebullets.com/shop?product_list_limit=all. Date accessed: Dec. 15, 2021.
https://cuttingedgebullets.com/277-6-8mm-100gr-esp-raptor. Date accessed: Dec. 15, 2021.
https://cuttingedgebullets.com/277-6-8mm-110gr-esp-raptor. Date accessed: Dec. 15, 2021.
https://cuttingedgebullets.com/277-6-8mm-85gr-esp-raptor. Date accessed: Dec. 15, 2021.
https://cuttingedgebullets.com/366-9-3mm-210gr-esp-raptor. Date accessed: Dec. 15, 2021.
https://cuttingedgebullets.com/416-300gr-esp-safari-raptor. Date accessed: Dec. 15, 2021.
https://www.lehighdefense.com/338-caliber-245gr-match-solid-target-rifle-bullets.html. Date accessed: Dec. 15, 2021.
https://www.lehighdefense.com/416-caliber-416gr-match-solid-target-rifle-bullets.html. Date accessed: Dec. 15, 2021.

* cited by examiner

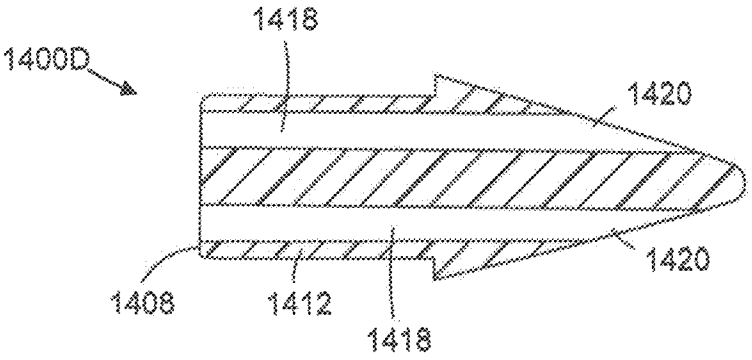
FIG. 14D
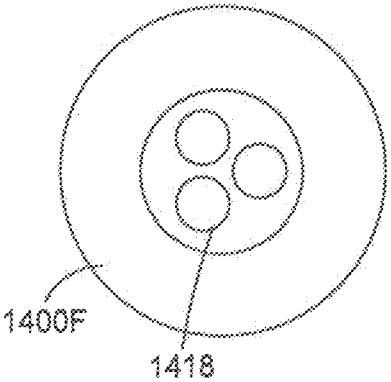
FIG. 14E
FIG. 14F
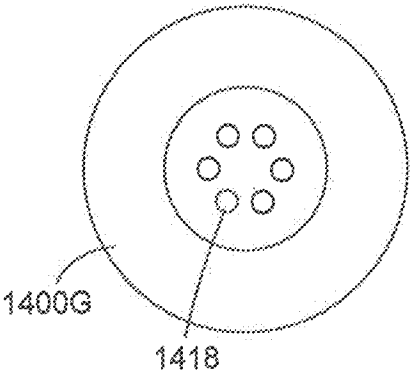
FIG. 14G

EXTENDED RANGE BULLET

CROSS REFERENCE TO RELATED APPLICATION

This application is a continuation of U.S. patent application Ser. No. 15/870,769 filed Jan. 12, 2018 which claims the benefit of U.S. Provisional Application Nos. 62/445,697 filed Jan. 12, 2017 and 62/518,334 filed Jun. 12, 2017, the entire contents of which are incorporated herein by reference.

FIELD OF THE DISCLOSURE

The present disclosure relates to firearm projectiles, and more specifically, to cartridges and bullets having a polymer tip.

BACKGROUND

In the sport of hunting, responsible hunters go to great lengths to ensure a quick, clean and humane kill. Hunters seek to select the best rifle, cartridge, bullet and optics for the particular species being hunted and the specific conditions likely to be encountered (e.g., rough terrain and thick underbrush). Hunters also practice marksmanship so that a shot can be carefully placed even under challenging circumstances. If a bullet is poorly placed, the game animal may travel a long distance through rough terrain after having been shot. In these situations, there is a risk that the wounded game animal will not be recovered.

Firearm projectiles, specifically bullets, may be designed as "hollow-points", having a central pit or generally hollowed out frontal cavity that causes the projectile to "upset" or expand upon impact with a target. Expansion may decrease penetration and as a result, increase the amount of kinetic energy transfer from the projectile to the target for improved stopping power. However, the central pit or hollowed out design may result in diminished aerodynamic characteristics. For example, the hollowed out design may increase axial drag which can reduce overall projectile accuracy and range.

To help counteract this, in some instances, hollow-point bullets may have a converging polymer tip that is inserted into the frontal cavity to mimic the shape of a spritzer or pointed bullet.

SUMMARY

Embodiments of the disclosure are directed to an expanding projectile for firing from a gun, the projectile including a projectile body and an expansion configured tip. In one or more embodiments, the projectile body includes a metal jacket extending from a tail portion to a nose portion and surrounding an interior solid core. The metal jacket is tapered along the nose portion to an annular forward edge where the jacket defines an opening to an interior region including a forward facing interior surface of the interior solid core. In one or more embodiments the expansion configured tip is positioned in the opening of the projectile and tapered forwardly from the annular forward edge to an ogive tip that defines a spitzer-type aerodynamic shape of the total projectile.

Various embodiments of the disclosure provide benefits from improved expansion characteristics for projectiles that impact a target at medium to lower impact velocities. In various instances, when a projectile is fired and begins to travel downrange, the forward velocity of the projectile will decay along over time and distance due to aerodynamic drag. As such, a projectile may fail to fully expand upon impact with a target at or beyond a certain range, as the projectile will lack the necessary velocity upon impact to cause projectile expansion. Alternatively, known projectiles will vary their mush This can be particularly true for projectiles with polymer tips. For example, known projectiles with polymer tips generally include tips that, upon impact, are pushed axially rearward towards the tail end of the projectile and compressed within the interior region. As such, known projectiles with conventional polymer tips can impede the path of fluid into the interior of the projectile, in turn impeding projectile expansion. As such, known polymer tips typically result in a higher impact velocity threshold for expansion, as compared to un-tipped projectiles.

As such, certain embodiments are directed to an expansion configured tip for low impact velocity consistent symmetrical expansion of a projectile. In various embodiments, the expansion configured tip is configured to provide, upon impact, one or more fluid pathways into the interior region of the projectile for improved projectile expansion characteristics at medium to lower impact velocities. This results in a projectile with improved expansion characteristics at longer ranges or at reduced impact velocities compared to known expanding projectiles while still maintaining the aerodynamic improvements of a polymer tipped round.

In addition, certain embodiments are directed to an expansion configured tip formed using a relatively high density or high strength material such as a steel, tungsten, other metal, or ceramic material. In various embodiments, the expansion configured tip is formed from other materials that are stronger more dense or harder than polymer. As such, one or more embodiments provide benefits in an expanding projectile with improved munition durability before and after firing. For example, one or more embodiments provide improved resistance to rough product handling, violent magazine and feed ramp function, and excessive tip heating due to aerodynamic drag. In addition, one or more embodiments provide benefits in an expanding projectile with improved penetration characteristics. As such, certain embodiments provide and expanding projectile with improved terminal performance through barriers and that routinely break apart conventional bullets upon impact.

In addition, various embodiments can change the visual appearance of an expanding projectile. For example, one or more embodiments include geometric features, such as tip radii and/or angles, shown to have an effect on the light performance. The bullet and casing may be nickel covered As such, one or more embodiments are directed to an expanding projectile including a projectile body including a metal jacket extending from a tail portion to a nose portion and surrounding an interior solid core. In various embodiments, the metal jacket is tapered at the nose portion in a forward direction to an annular forward edge, the annular forward edge defining an opening in the metal jacket to an interior cavity extending from the opening in a rearward direction to a forward facing interior surface of the interior solid core.

In one or more embodiments, a tip is mounted in the interior cavity and has an exterior surface substantially flush with an exterior surface of the metal jacket. In certain embodiments the tip has a main portion forward of the opening and a tip retention portion that at least partially fills the interior cavity. In certain embodiments the tip retention portion or stem of the tip that includes one or more fracture regions configured to, upon impact of the expanding projectile with a target, fracture or deform to expose one or more fluid pathways into the interior cavity and to the forward facing interior surface for initiating expansion of the projectile body. The fluidic pathways may extend through or past the stem to the core effecting initiating of the expansion. Upon effective initiation of expansion, the bullet continues to expand or mushroom which may be facilitated by skives at the forward end of the bullet body initially defining pedals that peel rearwardly. Bonding of the core to the jacket retains the deformed core material with the jacket even at close ranges.

In embodiments, a bullet with a central axis has a bullet body with a forward ogive portion with a forward opening, a mid-barrel engaging or bearing surface, and a rear boat tail portion. A tip is secured in the forward opening with a conical portion substantially flush with the ogive portion. A meplat is on the forward end of the tip. On the bearing portion, forward and rearward wall portions and a bottom wall defining a circumferential groove, the rearward wall having a lead-in surface or ramp from the bottom wall to the exterior surface of the bearing portion. In embodiments the ramp set an angle of from 20 to 45° measured from a line on the outer surface of the body portion parallel to the bullet axis with the 20 to 45° angle facing forward. In embodiments the ramp is from 18 to 34° as measured above. The ramp can extend a distance of 30 to 40% of the axial length of the groove. In embodiments the groove has a maximum depth of 0.008 inches±20%. The groove reduces the bearing surface contact area and provides a pedaling stop. In embodiments the groove is positioned in the forward half of the bearing surface portion lengthwise and is positioned in the rearward half of the bullet body lengthwise. The bullet body includes a lead core surrounded by a jacket comprising copper. The lead core extends from the within the forward opening rearward to the axial location of the groove. In embodiments the boat tail extends an axial length greater than 12% of total length of the bullet including the tip.

A feature and advantage of embodiments is weight retention at short and long shooting distances, for example from 50 yards to over 900 yards providing a highly effective hunting bullet. In embodiments a core comprising lead is bonded to a the jacket, the lead core extending rearwardly within the jacket to an axial position of where the groove is positioned on the exterior of the jacket, the position of the groove may provide a facilitating effect to pedaling upon impact through the full axial distance, the length of the core. A bullet expansion initiation means is provided with a tip. Such means may be a central fluidic pathway through the tip. In embodiments the fluidic pathway may be provided after fracturing of the forward conical portion of the tip from the stem portion wherein the stem portion is tubular. The fluidic pathway may be through the stem portion where it is tubular or around the stem portion where there are axially extending fluidic pathways on the exterior of the stem portion.

A further feature and advantage of embodiments is advantageous terminal effects at a wide range of bullet velocities and distances. For example, consistent expansion of the bullet occurs over a wide range of velocities which reflect a wide range of distances at which the bullet will perform, specifically perform with a consistent symmetrical mushrooming about the bullet axis, that is at short distances there may be a greater mushrooming effect than longer distances, but even up to 900 or more yards, the bullet can effectively mushroom without asymmetrical deformation pedals may be longer, the terminated bullet may be a longer due to the reduced mushrooming but the bullet still mushrooms. In embodiments, the consistent mushrooming is provided by a fluidic path through the forward opening of the bullet body facilitated by breaking of a conical portion of a tip from a stem portion in the bullet body forward opening. In embodiments, the stem portion may be tubular that then provides a central fluid path directly to the center of the lead core facilitating initiation of expansion of the bullet. Moreover, the tubular configuration facilitates fracture and/or deformation of the tip on impact providing a means for initiating the radial expansion, the mushrooming, of the bullet.

A feature and advantage of embodiments is a bullet with a very high ballistic coefficient providing enhanced hunting performance through a greater range of velocities and distances than conventional bullets and providing upset along with more consistent terminal performance over said greater range of velocities and distances.

A further feature and advantage of the invention is the casing and bullet may both be nickel plated providing a protective finish that facilitates handling of the bullet and provides an aesthetic advantage to discriminate the cartridge from other types of cartridges.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 14A-14D depicts cross section views of tips, according to one or more embodiments of the disclosure.

FIG. 14E-14G depicts top down views of tips, according to one or more embodiments of the disclosure.

Figure 1:
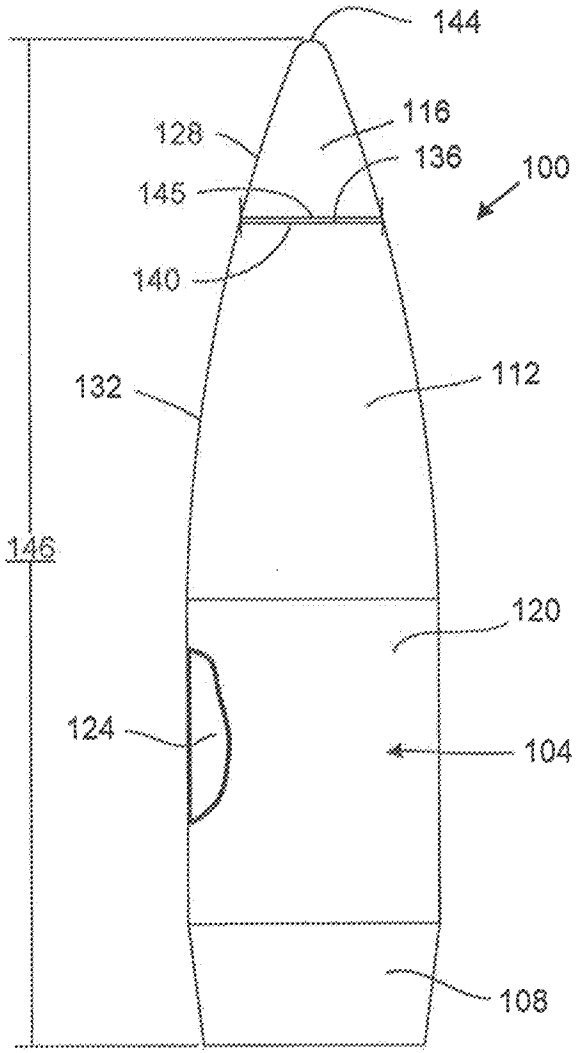
FIG. 1 depicts an expanding projectile according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a side view of an expanding projectile 100 is depicted according to one or more embodiments. The projectile 100 includes a projectile body 104 having a tail portion 108, a nose portion 112, and a tip 116 located forward of the nose portion 116.

In one or more embodiments, the projectile 100 is jacketed or plated, having a projectile body 104 composed of at least two parts including a metal jacket 120 that surrounds an interior solid core 124 depicted in FIG. 1 under a cutaway portion of the metal jacket 120. In various embodiments, the metal jacket 120 is a continuous piece of metal extending from the tail portion 108 to the nose portion 112, and defines the exterior of the expanding projectile 100.

Described further herein, in one or more embodiments the interior solid core 124, is composed of a malleable material, relative to the metal jacket 120 for expansion of the projectile body 104 upon impact with a target. In some embodiments, the interior solid core 124 is composed of lead, alloyed lead, or other suitable core material for expansion of the projectile body 104 upon impact. In various embodiments, the metal jacket 120 is composed of unalloyed copper, a copper alloyed with another metal, or other suitable projectile jacketing or plating material. For example, the metal jacket 120 may be composed of a copper-zinc alloy for covering the interior solid core 124 while firing the projectile from a barrel. The core material may be bonded to the jacket such as is described in U.S. Pat. Nos. 4,879,953; 4,793,037; 5,641,937; and 3,756,158 for example. These patents are incorporated herein by reference for all purposes.

In some embodiments, the projectile 100 is a lead-free projectile, where the projectile body 104 is a single, unitary piece of non-lead material. For example, in some embodiments, the body 104 is entirely composed of unalloyed copper, a copper alloyed with another metal, or other suitable non-lead material.

Described further herein, in one or more embodiments, the tip 116 defines a most forward portion for the projectile 100. In various embodiments, the tip 116 is a unitary structure having an exterior surface 128 that is substantially flush with an exterior surface 132 of the metal jacket 120 for forming a spitzer aerodynamic shape for the total projectile 100.

As such, in various embodiments, the exterior surface 128 of the tip 116 extends from a rearward portion 136, which is positioned directly adjacent to a forward portion 140 of the metal jacket 120, to a forward point 144 of the tip 116. In various embodiments, the tip 116 has a substantially pointed or ogive shape with a taper from the rearward portion 136 to the forward point 144 defined by an aspect ratio of the width 145 of the projectile 100 at the rearward portion 136 to the total length 146 of the projectile 100.

In various embodiments, the aspect ratio is in the range of 6.00 to 10.00. In certain embodiments the aspect ratio is in the range of 7.00 to 8.00. However, in various embodiments the aspect ratio can be higher or lower depending on the design and type of projectile 100.

In various embodiments, projectile 100 can be sized according to various different calibers. For example, in certain embodiments, the projectile could be a .308 Winchester round, 0.17 HMR, 0.22 Hornet, 0.223 Remington, 0.223 WSSM, .243 Winchester, 0.257 Roberts, .270 Winchester, 7 mm Remington Magnum, 0.30-06 Springfield, .300 Winchester Magnum, .338 Winchester Magnum, 0.375 H&H, 45.70 Gov't, and .458 Winchester Magnum. However, in certain embodiments, the projectile 100 could be sized to various other types of calibers not listed, but known in the art. The calibers of embodiments herein are utilized and suitable for hunting. In embodiments the bullet sizes are no greater than 50 caliber.

Figure 2A:
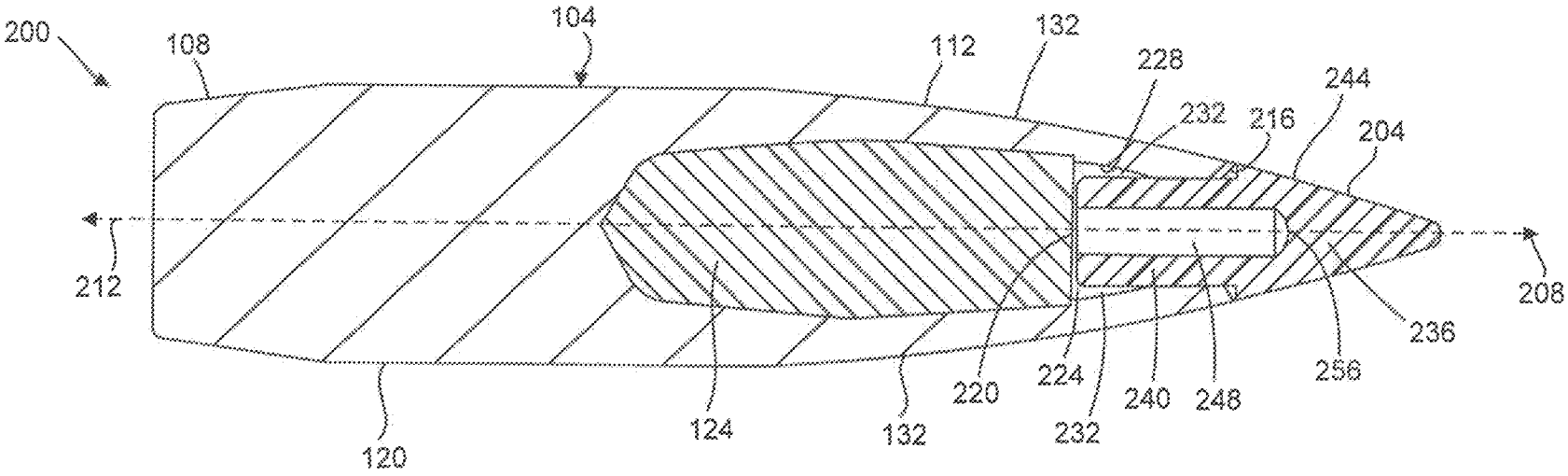
FIGS. 2A-2C, depict cross section views of an expanding projectile and a tip, according to one or more embodiments of the disclosure.
Figure 2B:
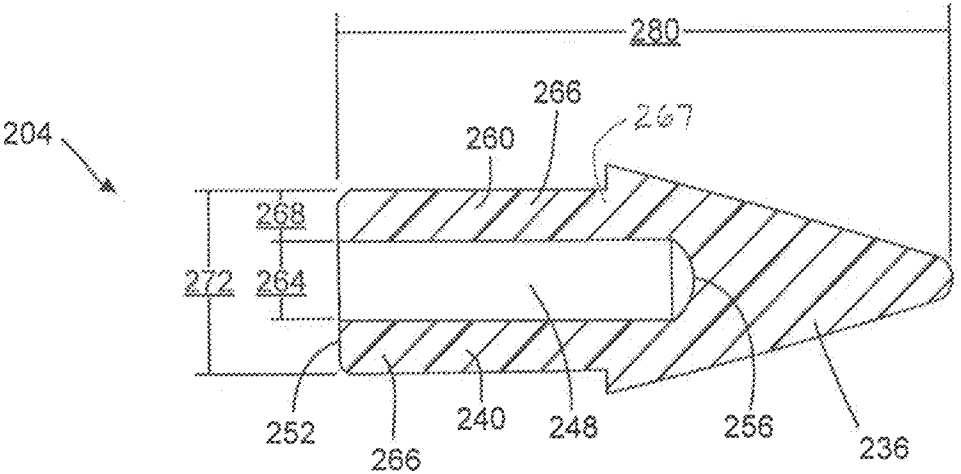

Referring to FIGS. 2A-2B, cross-section views of an expanding projectile 200 and a projectile tip 204 are depicted, according to one or more embodiments of the disclosure. In various embodiments, expanding projectile 200 shares one or more like elements with the expanding projectile 100 of FIG. 1. As such, like elements are referred to with the same reference numbers.

Expanding projectile 200 is jacketed, including a projectile body 104 composed of a metal jacket 120 extending from the tail portion 108 to the nose portion 116 and surrounding an interior solid core 124. The metal jacket 120 and nose portion 116 tapers in a forward direction, indicated by arrow 208 on a central axis 212. The metal jacket 120 extends to an annular forward edge 216 that defines an opening in the metal jacket 120 to expose a forward facing interior surface 220 of the interior solid core 124 and defines a scoop that facilitates opening upon impact with a target media that has a fluidic basis.

The interior solid core 124 is composed of a relatively malleable material so that, upon impact, the interior core material is compressed rearwardly, and the projectile 200 expands or mushrooms for increased transfer of kinetic energy to a target. In certain embodiments, the forward facing interior surface 220 is a substantially flat surface normal to the central axis 212. However, in some embodiments, the forward facing interior surface 220 may be asymmetrical, have a central indentation or depression, or may have other shape based on the design of the projectile 200, on manufacturing variations, or on other factors.

In one or more embodiments, the expanding projectile 200 includes a central cavity 224 extending from the opening defined by the annular forward edge 216 to the forward facing interior surface 220. In some embodiments, the size and shape of the central cavity 224 is defined by the forward facing interior surface 220 and the interior surface 228 of the metal jacket 120, forward of the forward facing interior surface 220. In various embodiments, the central cavity 224 has a conical shape or other shape in the interior of the projectile 200. In certain embodiments, the central cavity 224 can extend into the interior solid core 124 for enhancing mushrooming characteristics of the expanding bullet 200 upon impact.

In certain embodiments, the central cavity 224 has an undercut shape, as the metal jacket 120 tapers from the forward facing interior surface 220 to the opening such that the opening has a diameter smaller than that of the width of the forward facing interior surface 220 and defines undercut corner regions 232. As used herein, the undercut corner regions 232 are defined as the portion of the cavity 224 exterior to an axially extending cylinder with the radius equal to the opening.

In one or more embodiments, the tip 204 defines a most forward tip for the projectile 200. The tip 204 is a unitary structure including a main portion 236 and a tip retention portion 240 rearward of the main portion 236 and opening. The main portion 236 has an exterior surface 244 substantially flush with the exterior surface 132 of the metal jacket 120 for forming a relatively streamlined or spitzer aerodynamic shape.

In various embodiments, the tip retention portion 240 is a plug element that, when assembled in the central cavity 224, resists axial movement of the tip 240 and retains it in place in the projectile body 104. In one or more embodiments, tip retention portion 240 is a cylindrical plug. In certain embodiments, tip retention portion 240 can have other shapes, for example, tip retention portion 240 could be rectangular, hexagonal, or have other suitable shape.

In one or more embodiments, the tip retention portion 240 includes a blind hole or axial recess 248 along the central axis of the tip 204 from a rear end 252 of the tip retention portion 204 to a recess end point 256 within the interior of the tip 204.

In certain embodiments, the axial recess 248 is cylindrical hole that defines a tubular sidewall 260 of the tip retention portion 240. In various embodiments, the axial recess 248 has a diameter 264 to define a thickness 268 of the sidewall 260. For example, in one or more embodiments, the diameter 264 of the axial recess 248 is approximately in the range of 10% to 70% of a total diameter 272 of the tip retention portion 240. As a result, in some embodiments, the sidewall 260 has a thickness 268 in the range of 45% to 15% of the total diameter 272 of the tip retention portion 240. In some embodiments, the axial recess 248 has a diameter 264 in the range of 80% to 60% of the total diameter 272 of the tip retention portion 240. As a result, in some embodiments, the sidewall has a thickness 268 in the range of 10% to 20% of the total diameter 272 of the tip retention portion 240. However, in various embodiments, the diameter of the axial recess 248 and the corresponding thickness of the sidewall 260 can be selected as any suitable value, described further below.

In one or more embodiments, tip retention portion 240 includes a fracture region 266. Fracture region 266 is a portion of the tip 204 that is configured to fracture or deform upon impact of the projectile 200 with a target, described further below. As such, the fracture region 266 provides a weak point for the main portion 236 of the tip to break off such as at the juncture 267 of the main portion and tip retention portion, while still leaving the main portion 236 as solid as possible to resist the heating of air friction that occurs during projectile flight. In various embodiments, the fracture region 266 includes portions of the tip retention portion 240 that are designed to fracture or deform at a particular impact velocity or impact force. For example, in one or more embodiments, the fracture region 266 is configured to fracture or deform at impact energies associated with velocities as low as 1500 feet per second. In some embodiments, the fracture region 266 is configured to fracture or deform at impact energies associated with velocities as low as 1000 feet per second. For example, in certain embodiments, the fracture region 266 is configured to fracture or deform at impact energy as low as 800 foot pounds. However, in various embodiments, fracture regions can be designed to fracture at higher or lower impact velocities or with various energy requirements based on the structural strength of the fracture region.

For example, depicted in FIG. 2B, fracture region 266 includes the sidewall 260. In various embodiments, due to the axial recess 248, the sidewall 260 forms the structurally weakest element of the tip 204. Described further below, upon impact with a target or object at sufficient speed or with sufficient force, the sidewall 260 will fracture or deform.

In one or more embodiments, the axial recess 248 extends from the rear end 252 to the recess end point 256 that is within the interior of the tip 204 and which is forward of the end 216 of the metal jacket 120. As such, in various embodiments, the tubular sidewall 260 is in contact with the metal jacket 120 at the annular forward end 216.

Figure 2C:
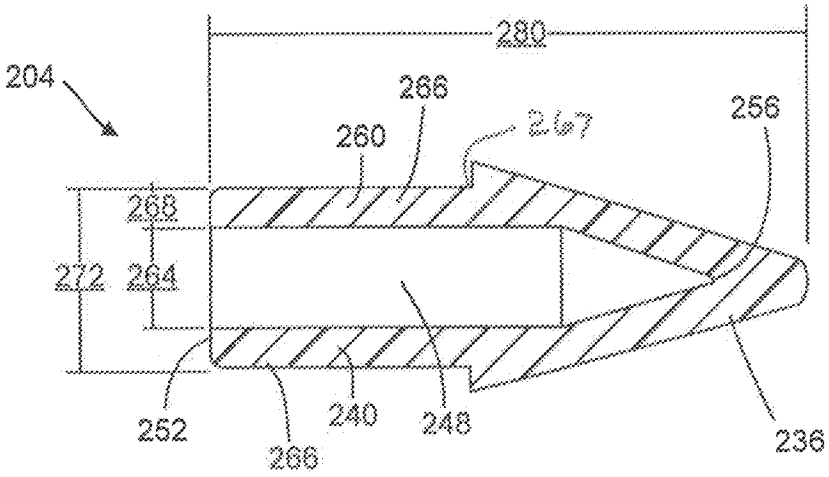

In certain embodiments, the axial recess 248 extends through at least 50% to 80% of the total length 280 of the tip 204. For example, referring to FIG. 2B, the recess end point 256 is positioned at approximately 60% of the length 280 of the tip 204, measured from the rear end 252. In embodiments the cavity extends forwardly beyond the forward edge of the bullet body. Referring to FIG. 2C, in some embodiments, the recess end point 256 is positioned approximately 80% of the length 280 of the tip 204, as measured from the rear end 252. However, in various embodiments, the axial recess 248 can extend through greater or lesser lengths.

Figure 3A:
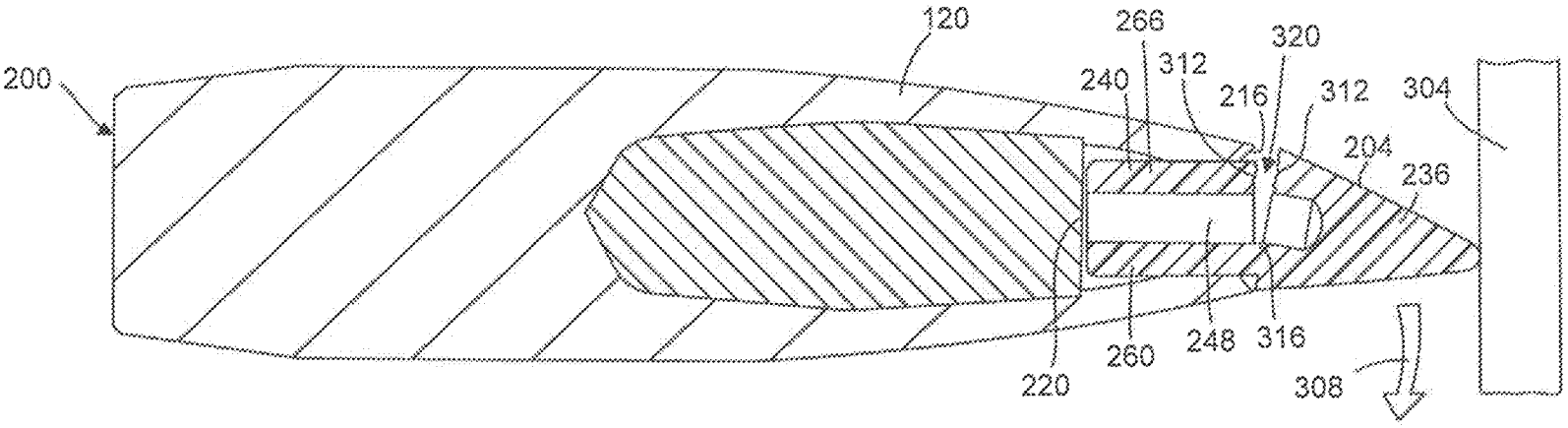
FIGS. 3A-3C depict cross section views of an expanding projectile upon initial impact with a target, according to one or more embodiments of the disclosure.
Figure 3B:
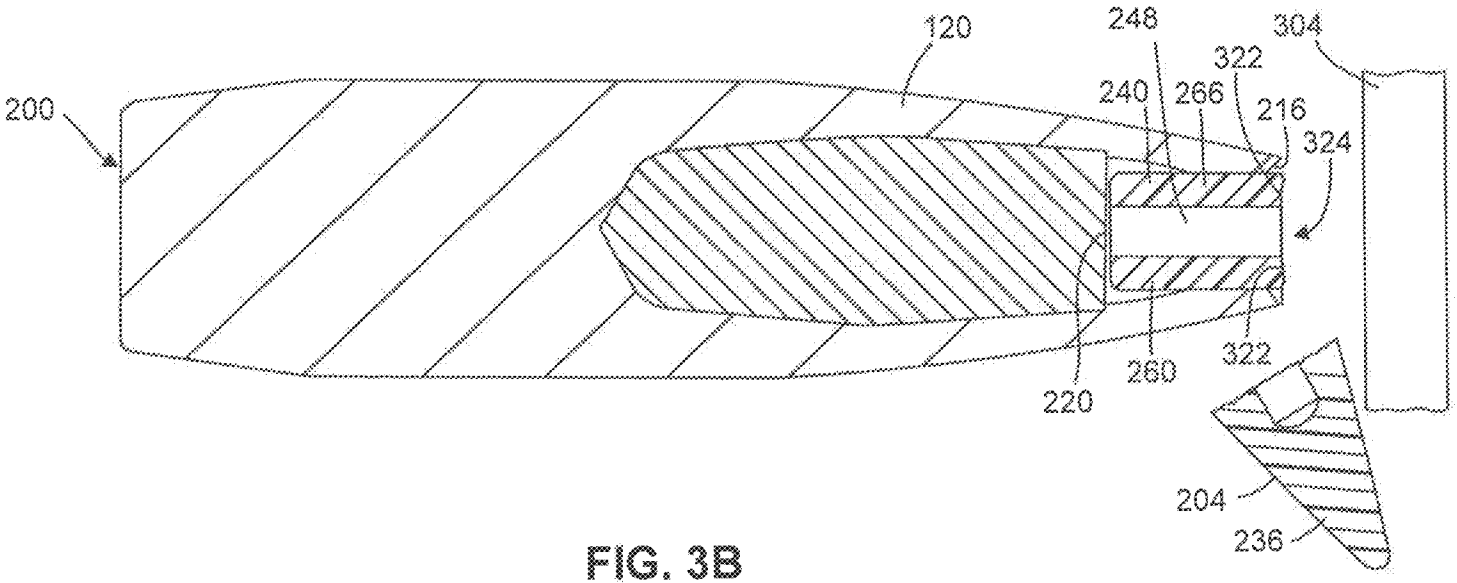
Figure 3C:
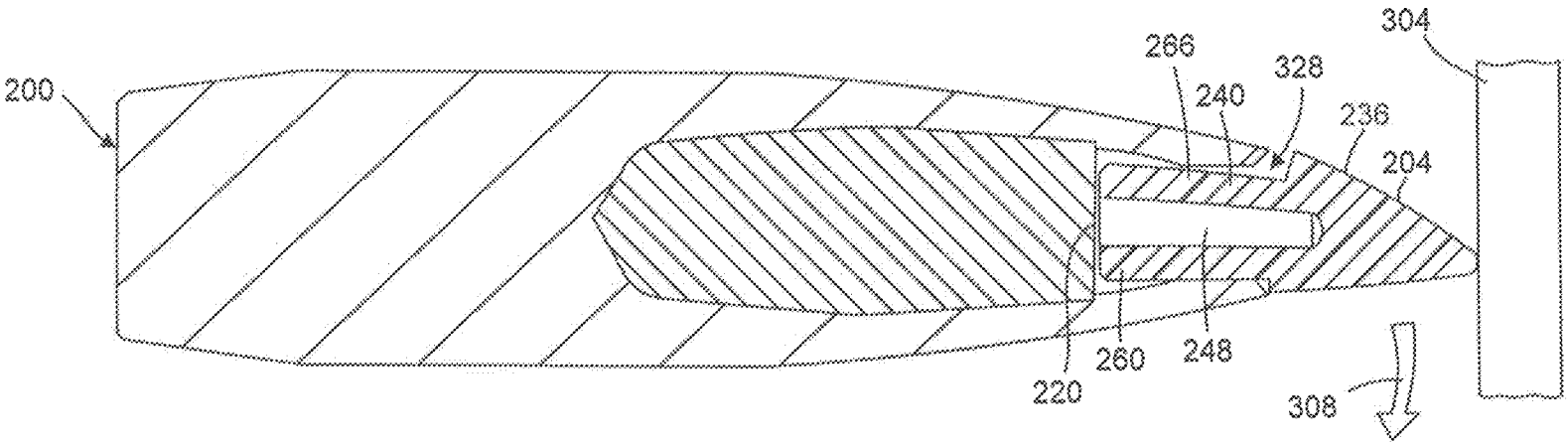

Referring to FIGS. 3A-3C, in operation, the projectile 200 is fired at a target 304. In various embodiments, the projectile 200 is spin stabilized due to being fired from a rifled barrel and has a rotating or spinning trajectory. FIGS. 3A and 3B depict the projectile 200 upon impact with the target 304. In various embodiments, the spinning trajectory of the projectile 200 results in a torqueing force, depicted as arrow 308, which is applied onto the tip 204 on impact with the target 304. As a result, in one or more embodiments, the torqueing force can cause deformation or fracturing in a lateral direction, substantially normal to the direction of the trajectory of the projectile 200. In addition, in certain embodiments, the tip 204 is constructed to have sufficient structural integrity to maintain its form during firing and projectile flight but is constructed to reliably deform or fracture upon impact. For example, depicted in FIGS. 3A-3C, in various embodiments the tip 204 is designed to reliably deform or fracture along one or more portions of the sidewall 260 of the tip retention portion 240 due to the axial recess 248 and the relatively thin material of the sidewall 260. Further, in various embodiments, the tip 240 is designed to, as a result of fracture or deformation, provide an opening or passageway for fluid to enter the interior of the projectile and to contact the forward facing interior surface 220.

In certain embodiments, the number of and location of fractures or deformation of the tip 204 can vary based on normal deviations in materials and manufacturing of the tips 204, the amount of and location of force on the tip 204 upon impact, and other various factors.

For example, depicted in FIG. 3A, due to the force generated on the tip 204 the tip 204 begins to fracture in one or more locations 312 in the tip retention portion 240 such that at least some of the main portion 236 separates from the tip retention portion 240. In various embodiments, this results because as the main portion 236 is torqued, the tip retention portion 240 is maintained within the interior of the projectile 200 and held by its fit within the metal jacket 120. As such, the material of the tip retention portion 240 is strained and, with sufficient force, breaks or fractures the sidewall 260 of the tip retention portion 240.

In FIG. 3A, tip 204 includes fracture points 312 located at the annular end 216 of the metal jacket 120 while another part of the sidewall 260 at point 316 has warped and stretched under the strain of the torque. However, this part of the sidewall 260 has not fractured and maintains its connection with the main portion 236. As a result of the fracture, an opening 320 is created into the interior of the tip retention portion 240 providing access into the axial recess 248. As a result, a fluid pathway is created through the opening 320 and axial recess 248 to expose the forward facing interior surface 220 of the projectile 200 to aid projectile expansion.

Depicted in FIG. 3B, the tip 204 fractures at points 322 upon impact such that the main portion 236 is torn or fractured from the tip retention portion 240. As a result, opening 324 is created providing access into the axial recess 248. Thus, a fluid pathway is created through the opening 324 and axial recess 248 to the forward facing interior surface 220 of the projectile 200.

Depicted in FIG. 3C, the tip 204 deforms upon impact such that the main portion 236 and tip retention portion 240 are deformed. For example, in one or more embodiments, the main portion 236 and the tip retention portion 240 are compressed as a result of torqueing forces on the tip 204. An opening 328 is therefore created from the deformed shape of the tip retention portion 240 providing access into the interior of the projectile 200 and to the forward facing interior surface 220.

In various embodiments, the torque or force required to fracture or deform the tip 204 is based on the materials used in the tip 204. For example, in one or more embodiments, the tip 204 can be constructed from polymer, elastomer, metal, ceramic or other material. In various embodiments, the energy required to fracture the tip 204 will depend upon the material used on and the design of the tip 204. For example, thinner or weaker structural portions of the tip 204 will have different energy requirements for deformation or fracture than thicker and stronger structural portions of the tip 204.

In some embodiments, the tip 116 could be constructed using a combination of materials. For example, in one or more embodiments, the tip 116 could be constructed from a combination of metal and polymer, with polymer portions located at strategic areas that are designed to fracture at lower energy requirements than a solid metal tip 116.

Figure 4A:
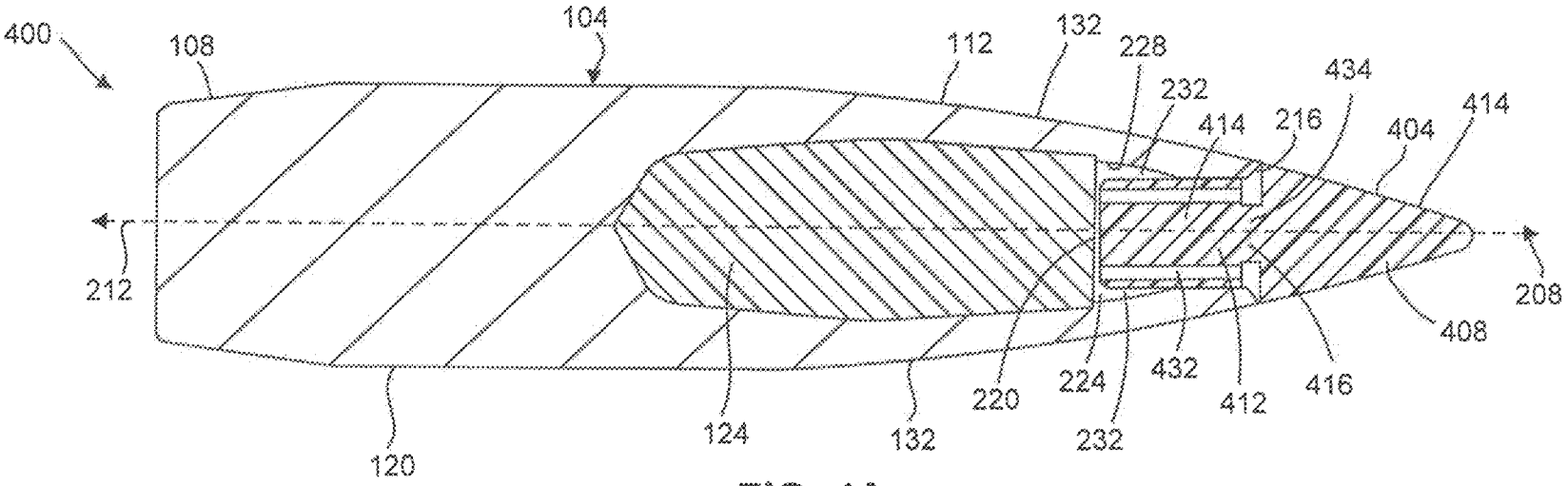
FIGS. 4A & 4B depict cross section views of an expanding projectile, according to one or more embodiments of the disclosure.
Figure 4B:
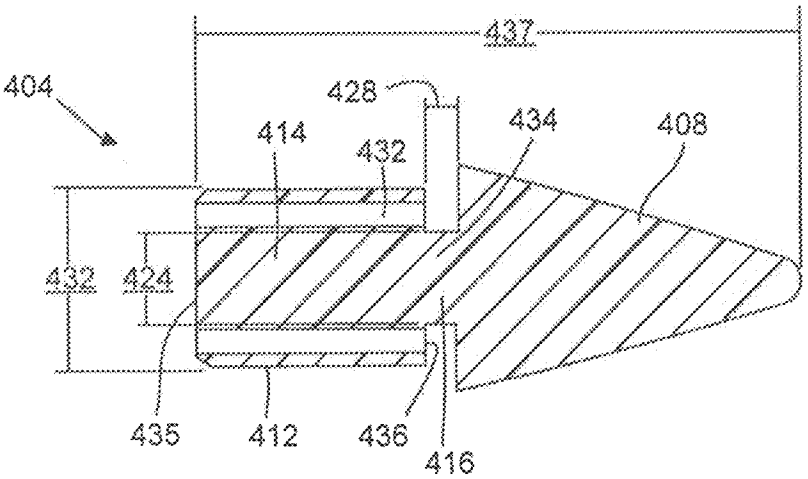

Referring to FIGS. 4A and 4B, cross-section views of an expanding projectile 400 are depicted, according to one or more embodiments of the disclosure. In various embodiments, expanding projectile 400 shares one or more like elements with the expanding projectile 200 of FIGS. 2A and 2B. As such, like elements are referred to with the same reference numbers.

For example, expanding projectile 400 is jacketed, including a metal jacket 120 defining a projectile body 104 extending from the tail portion 108 to a nose portion 112 and surrounding an interior solid core 124. The metal jacket 120 extends to an annular forward edge 216 that defines an opening in the metal jacket 120 to expose an interior solid core 124 and a forward facing interior surface 220. In one or more embodiments, the expanding projectile 400 includes a central cavity 224 extending from the opening defined by the annular forward edge 216 to the forward facing interior surface 220.

In one or more embodiments, the expanding projectile 400 includes a tip 404 defining a most forward tip for the projectile 400. The tip 404 is a unitary structure including a main portion 408 and a tip retention portion 412 rearward of the main portion 408 and opening. The main portion 412 has an exterior surface 414 substantially flush with an exterior surface 132 of the metal jacket 120 for forming a relatively streamlined or spitzer aerodynamic shape.

In various embodiments, the tip retention portion 412 is a plug element that, when assembled in the central cavity 232, resists axial movement of the tip 404 and retains it in place in the projectile body 104. In various embodiments, tip retention portion 412 is a cylindrical plug. In certain embodiments, tip retention portion 412 can have other shapes, for example, tip retention portion 412 could be rectangular, hexagonal, or have other suitable shape.

In one or more embodiments, the tip retention portion 412 includes a shoulder portion 414 and a neck portion 416 that is connected to the main portion 408. In various embodiments, the neck portion 416 defines a generally thinner and structurally weaker portion of the tip retention portion 412 having a thinner area of material for connection to the main portion 408. For example, in one or more embodiments, the neck portion 416 has a thickness 424 and a width 428 compared to a shoulder width 432 of the shoulder portion 414. In certain embodiments, the neck portion 416 has a thickness 424 approximately in the range of 33% to 10% of the width 432 of the shoulder portion 420. In some embodiments the neck portion 416 has a thickness 428 approximately in the range of 5% to 20% of the total length 437 of the tip 404.

In one or more embodiments, tip retention portion 412 includes a fracture region 434. Similarly as described above with reference to FIGS. 2A-3C, fracture region 434 is a portion of the tip 404 that is configured to fracture or deform upon impact of the projectile 400 with a target, described further below. In various embodiments, the fracture region 434 includes portions of the tip retention portion 412 that are designed to fracture or deform at a particular impact velocity or impact force. For example, in one or more embodiments, the fracture region 434 is configured to fracture or deform at impact velocities as low as 1500 feet per second. In some embodiments, the fracture region 434 is configured to fracture or deform at impact energies associated with velocities as low as 1000 feet per second. For example, in certain embodiments, the fracture region 434 is configured to fracture or deform at impact energy as low as 800 foot pounds. However, in various embodiments, fracture regions can be designed to fracture at higher or lower impact energies or velocities or based on the structural strength of the fracture region 434.

For example, depicted in FIG. 4B, fracture region 434 includes the neck portion 416. In various embodiments, due to the generally reduced width 428 and thickness 424 of the neck portion 416, as compared to the main portion 408 and the shoulder portion 414, the neck portion 416 forms the structurally weakest element of the tip 404. Described further below, upon impact with a target or object at sufficient speed or with sufficient force, the neck portion 416 will fracture or deform.

In various embodiments, the shoulder portion 420 includes one or more axial recesses 432. As used herein, axial recess refers to any hole or cut out portion in the tip 404 that extends lengthwise or substantially parallel to the central axis of the tip 404. For example, axial recesses 432 are offset from the central axis of the tip, but extend lengthwise from the rear end 435 to a recess end point 436. In certain embodiments, the axial recess 432 extends through at least 40% to 80% of the total length 437 of the tip 404. For example, referring to FIG. 4B, the recess end point 436 is positioned at approximately 50% of the length 437 of the tip 404, measured from the rear end 435. However, in various embodiments, the axial recess 432 can extend through greater or lesser lengths of the tip 404.

Figure 5A:
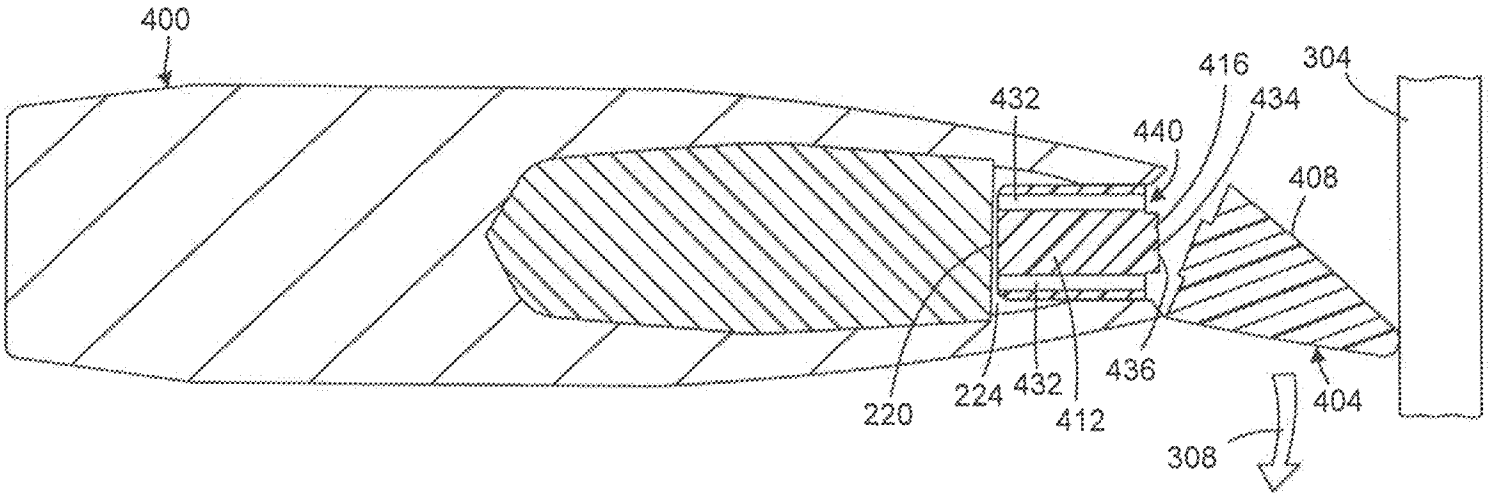
FIGS. 5A & 5B depict cross section views of an expanding projectile upon initial impact with a target, according to one or more embodiments of the disclosure.
Figure 5B:
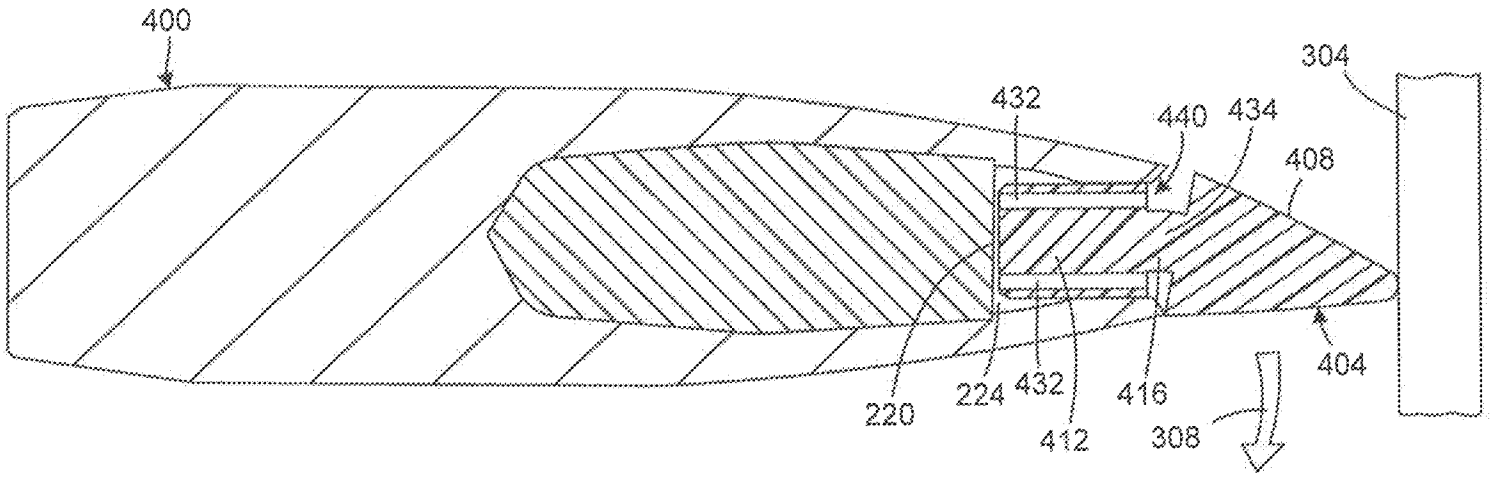

Referring to FIGS. 5A-5B, in operation, the projectile 400 is fired at a target 304. In various embodiments, the projectile 400 is spin stabilized due to being fired from a rifled barrel and has a rotating or spinning trajectory. FIGS. 5A-5B depict the projectile 400 upon impact with the target 304. In various embodiments, the spinning trajectory of the projectile 400 results in a torqueing force, depicted as arrow 308, which is applied onto the tip 404 on impact with the target 304. As a result, in one or more embodiments, the torqueing force can cause deformation or fracturing of the fracture region 434 in a lateral direction, substantially normal to the direction of the trajectory of the projectile 400.

In addition, in certain embodiments, the fracture region 434 is constructed to have sufficient structural integrity to maintain its form during firing and projectile flight but is constructed to reliably deform or fracture upon impact. For example, depicted in FIGS. 5A-5B, in various embodiments the fracture region 434 is designed to reliably deform or fracture in the neck portion 416 due to the relatively thin material compared to the shoulder portion 420 of the tip retention portion 412.

Further, in various embodiments, the tip 404 is designed to, as a result of fracture or deformation, provide an opening 440 or passageway for fluid to enter the interior of the projectile and to contact the forward facing interior surface 220.

For example, depicted in FIG. 5A, due to the force generated on the tip 404, the neck portion 416 of the tip retention portion 412 begins to fracture in one or more locations 436 such that the main portion 408 is separated from the tip retention portion 412. In various embodiments, this results because as the main portion 408 is torqued, the tip retention portion 412 is maintained within the interior of the projectile 400 and held by its fit within the metal jacket 120. As such, the fracture region 434 of the tip retention portion 412 is strained and, with sufficient force, fractures or deforms the neck portion 416.

In FIG. 5A, the tip 404 fractures upon impact such that the main portion 408 is torn or fractured from the tip retention portion 412. As a result, opening 440 is created into the interior of the tip retention portion 412 and provides access to axial recesses 432. Thus, a fluid pathway is exposed through the opening 440 and fluid passageways 432 to the forward facing interior surface 220 to aid projectile expansion.

Depicted in FIG. 5B, the tip 404 deforms upon impact such that the main portion 408 and tip retention portion 412 are deformed. For example, in one or more embodiments, the main portion 408 and the tip retention portion 412 are compressed together in a lateral direction as a result of torqueing forces on the tip 404. An opening 440 is therefore created from the deformed shape of the tip retention portion 400 providing access to one or more of the axial recesses 432.

As described above, in various embodiments, the torque or force required to fracture or deform the tip 404 is based on the materials used in the tip 404. For example, in one or more embodiments, the tip 404 can be constructed from polymer, elastomer, metal, ceramic or other material. In various embodiments, the energy required to fracture the tip will depend upon the material used on and the design of the tip 404. For example, thinner or weaker structural portions of the tip 404 will have different energy requirements for deformation or fracture than thicker and stronger structural portions of the tip 404. In some embodiments, the different portions of the tip 404 can be constructed from different materials. For example, in some the main portion 408 or other elements of the tip 404 could be constructed from at least one of metal or ceramic and the fracture region 434 could be constructed from a polymer material. A suitable material for the tip has been found to be polyphenylsulfone (PPSU). Transparent polymers may be utilized providing visibility of the cavity from exterior of the bullet.

In certain embodiments, the number of and location of fractures or deformation of the tip 404 can vary based on normal deviations in materials and manufacturing of the tips 404, the amount of and location of force on the tip 404 upon impact, and other various factors.

Referring to FIGS. 5A-12B, various tips are depicted, according to one or more embodiments of the disclosure.

Figure 6A:
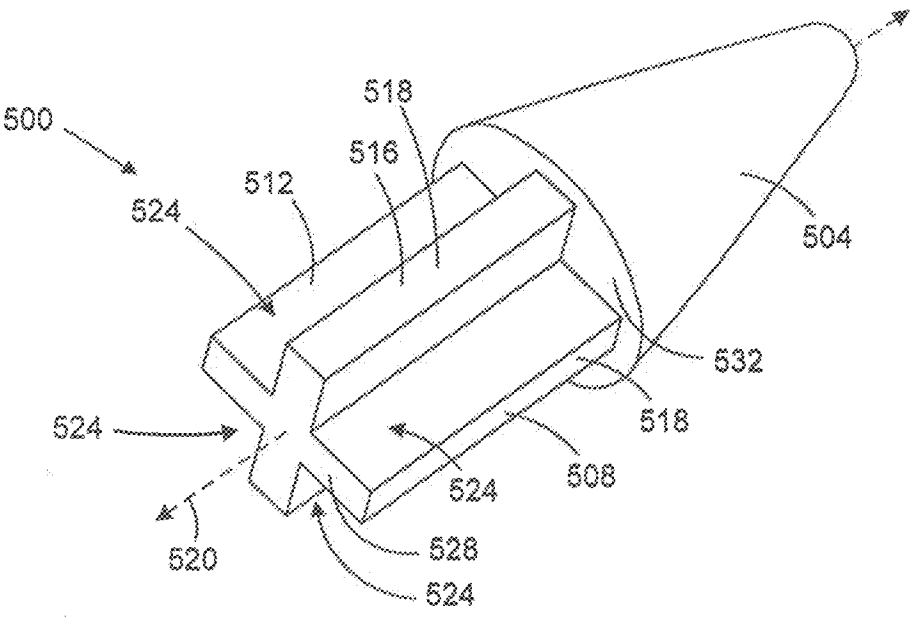
FIGS. 6A & 6B depict perspective and rear views of a tip for an expanding projectile, according to one or more embodiments of the disclosure.
Figure 6B:
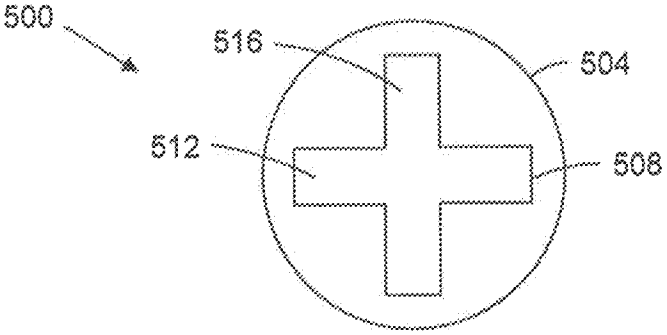

For example, referring to FIGS. 6A & 6B, a tip 500 is depicted having a main portion 504 and a tip retention portion 508. In various embodiments, the tip retention portion 508 can be constructed with various designs. For example, tip retention portion 508 is cross shaped or teeshaped having a widthwise portion 512 and a crosswise portion 516 that intersect along a central axis 520. Crosswise portion 516 and widthwise portion 512 provide a plurality of outwardly facing surfaces 518 that allow for frictional mounting the tip 500 within an interior of an expanding projectile. Further, as a result of the crosswise and widthwise portions 512, 516, four axial recesses 524 are defined extending from a rear end 528 of the tip retention portion 508 to a rear end 532 of the main portion 504. Further, a fracture region is defined in the tip retention portion 508 by the widthwise and the crosswise portions 512, 516 as the tip 500 is configured to either deform or fracture upon impact to expose one or more openings into the axial recesses 524 which would in turn provide a fluid passageway to interior surfaces of an expanding projectile, as described above.

Figure 7A:
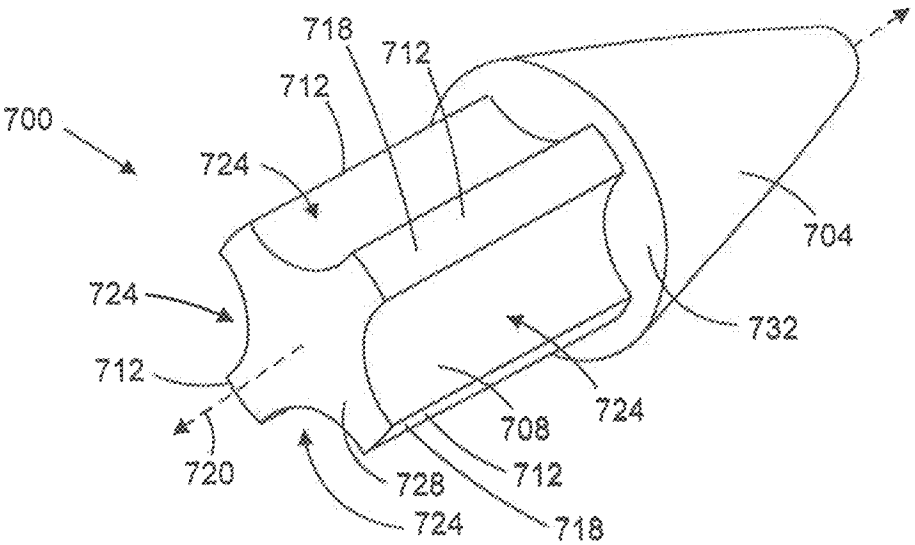
FIGS. 7A & 7B depict perspective and rear views of a tip for an expanding projectile, according to one or more embodiments of the disclosure.
Figure 7B:
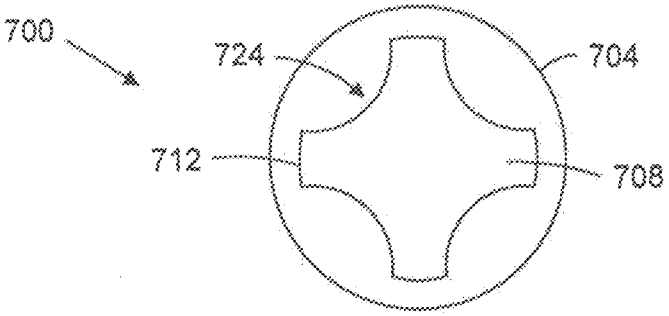

Referring to FIGS. 7A & 7B, a tip 700 is depicted having a main portion 704 and a tip retention portion 708. In one or more embodiments, tip retention portion 708 includes one or more splines 712 which extend radially from a central axis 720 and extend along the length of the tip retention portion 708. Depicted in FIGS. 7A & 7B, four splines 712 are shown, however, in various embodiments fewer or greater amounts of splines 712 could be included in the tip retention portion 708 based on the preferred design. In various embodiments, the one or more splines 712 provide a plurality of outwardly facing surfaces 718 that allow for frictional mounting of the tip 700 within an interior of an expanding projectile.

As a result of the splines 712 four axial recesses 724 are defined extending from a rear end 728 of the tip retention portion 708 to a rear end 732 of the main portion 704. Further, a fracture region is defined in the tip retention portion 708 by the splines 712 as the tip retention portion 708 is configured to either deform or fracture upon impact to expose one or more openings into the axial recesses 724, which would expose interior surfaces of an expanding projectile, as described above.

Figure 8A:
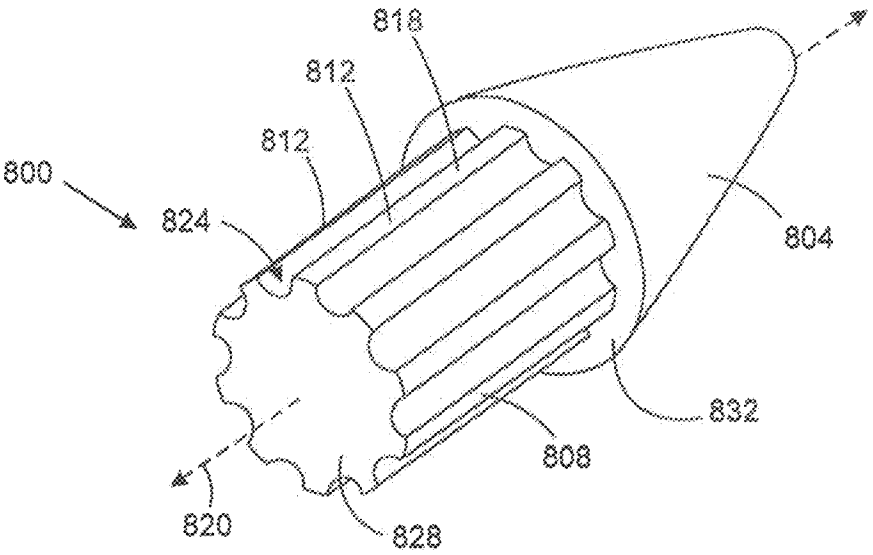
FIGS. 8A & 8B depict perspective and rear views of a tip for an expanding projectile, according to one or more embodiments of the disclosure.
Figure 8B:
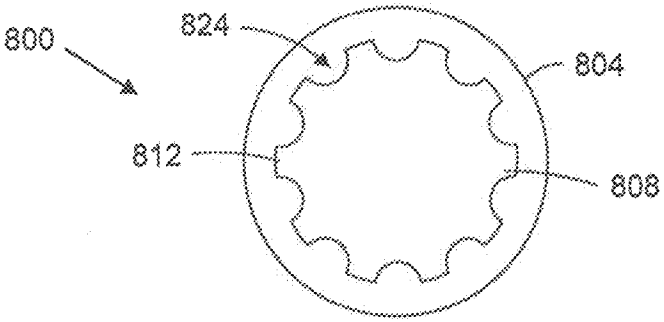
Figure 9A:
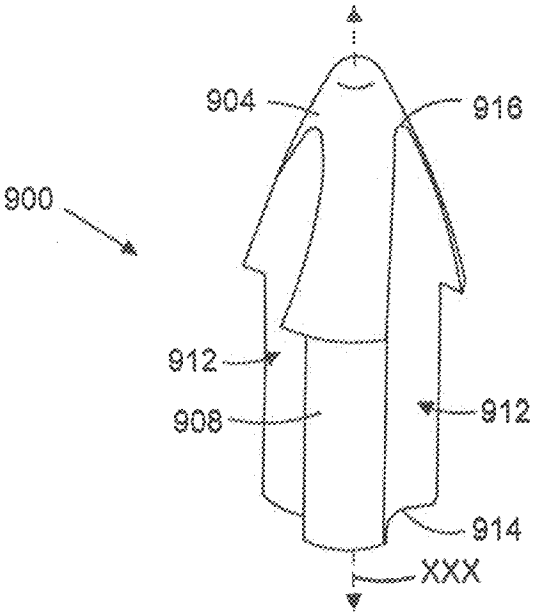
FIGS. 9A & 9B depict perspective and top down views of a tip for an expanding projectile, according to one or more embodiments of the disclosure.
Figure 9B:
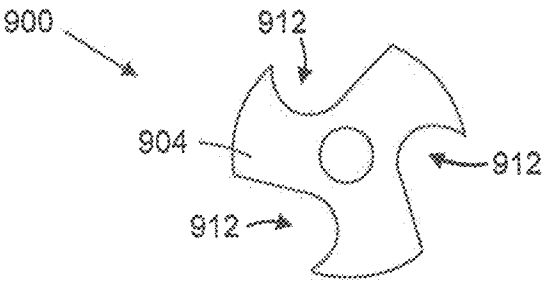

Referring to FIGS. 8A & 8B, a tip 800 is depicted having a main portion 804 and a tip retention portion 808. In one or more embodiments, tip retention portion 808 includes a plurality of splines 812 which extend outwardly radially along a central axis 820. Depicted in FIGS. 8A & 8B, ten splines 812 are shown, however, in various embodiments fewer or greater amounts of splines 812 could be included in the tip retention portion 808 based on the preferred design. In various embodiments, the plurality of splines 812 provide a plurality of outwardly facing surfaces 818 that allow for frictional mounting of the tip 800 within an interior of an expanding projectile.

As a result of the splines 812 ten axial recesses 824 are defined extending from a rear end 828 of the tip retention portion 808 to a rear end 832 of the main portion 804. Further, a fracture region is defined in the tip retention portion 808 by the splines 812 as the tip retention portion 808 is configured to either deform or fracture upon impact to expose one or more openings into the axial recesses 824, which would expose interior surfaces of an expanding projectile, as described above.

Referring to FIGS. 9A-10B, in one or more embodiments, a tip can include a one or more axial recesses that extend through both the tip retention portion and a substantial portion of the main portion. For example, referring to FIGS. 9A-9B, a tip 900 is depicted having a main portion 904 and tip retention portion 908. In addition, a plurality of axial recesses 912 extend from a rear end 914 of the tip to a recess end point 916 positioned in the main portion 904 and define a splined shape for the tip 904, depicted in the top down profile view in FIG. 9B. Further, when mounted in an expanding projectile, the tip 900 includes one or more openings into the axial recesses 912 without fracture or deformation, to ensure exposure of interior surfaces of an expanding projectile, as described above.

Figure 10A:
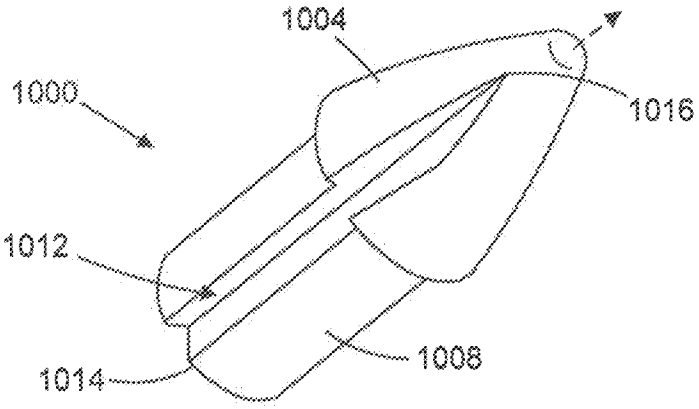
FIGS. 10A & 10B depict perspective and top down views of a tip for an expanding projectile, according to one or more embodiments of the disclosure.
Figure 10B:
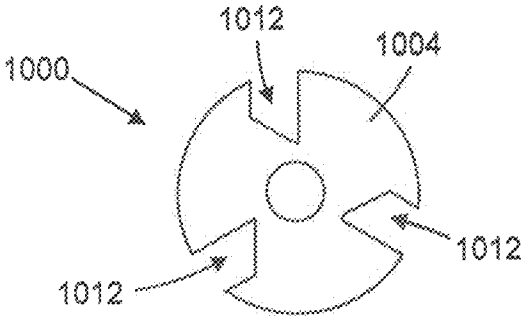

Similarly, FIG. 10A-10B depicts a tip 1000 having a main portion 1004 and tip retention portion 1008 with a plurality of axial recesses 1012 extend from a rear end 1014 of the tip 1000 to a recess end point 1016 positioned in the main portion 1004. As such, when mounted in an expanding projectile, the tip 1000 includes one or more openings into the axial recesses 1012 without fracture or deformation, to ensure exposure of interior surfaces of an expanding projectile, as described above.

Referring to FIGS. 11A-12C, in one or more embodiments, a tip can include one or more axial recesses in a main portion for improved fracturing or deformation of a fracture region.

Figure 11A:
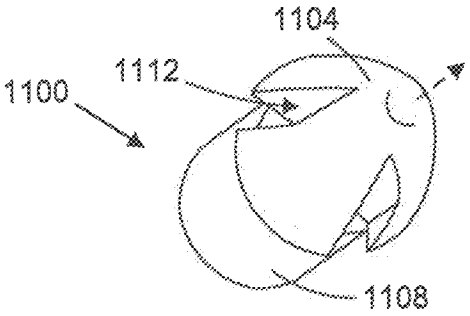
FIG. 11A-11C depict perspective, top down, and side views of a tip for an expanding projectile, according to one or more embodiments of the disclosure.
Figure 11B:
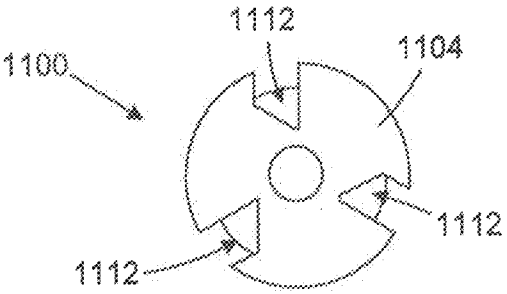
Figure 11C:
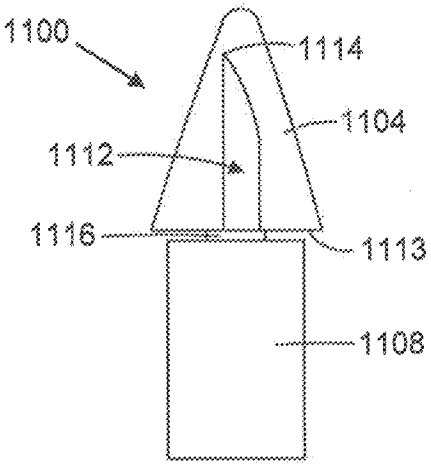

For example, referring to FIGS. 11A-11C, in one or more embodiments a tip 1100 having a main portion 1104 and tip retention portion 1108. A plurality of axial recesses 1112 extend from a rear end 1113 of the main portion to a recess end point 1114 in the main portion 1104. In addition, tip retention portion 1108 includes a fracture region 1116 in the tip retention portion 1108 from a neck portion that connects a wider shoulder portion to the main portion 1104. In various embodiments, axial recesses 1112 provide an opening exposing the fracture region 1116 for increased aerodynamic friction on the fracture region 1116 to assist in deformation or fracture upon impact, as described above.

Figure 12A:
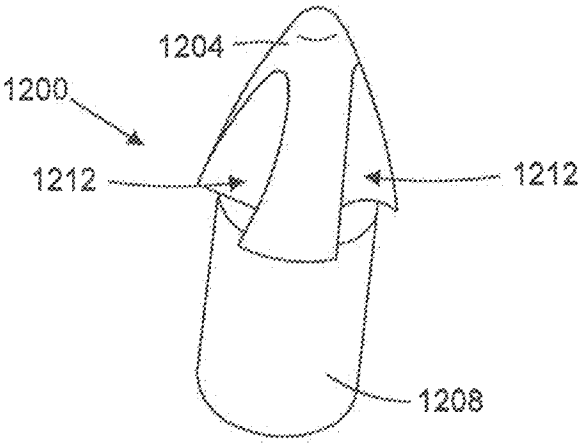
FIG. 12A-12C depict perspective, top down, and side views of a tip for an expanding projectile, according to one or more embodiments of the disclosure.
Figure 12B:
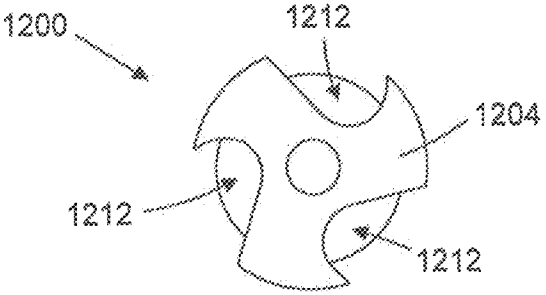
Figure 12C:
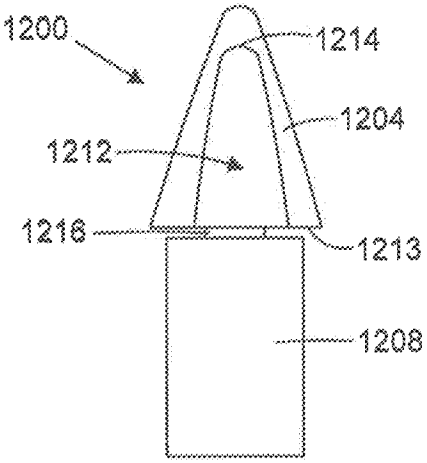

In FIGS. 12A-12C a tip 1200 is depicted having a main portion 1204 with a plurality of axial recesses 1212 extend from a rear end 1213 of the main portion to a recess end point 1214. In addition, a tip retention portion 1208 includes a fracture region 1216 in the tip retention portion 1208 from a neck portion that connects a wider shoulder portion to the main portion 1204. In various embodiments, axial recesses 1212 provide an opening exposing the fracture region 1216 for increased aerodynamic friction on the fracture region 1216 to assist in deformation or fracture upon impact, as described above.

Figure 13:
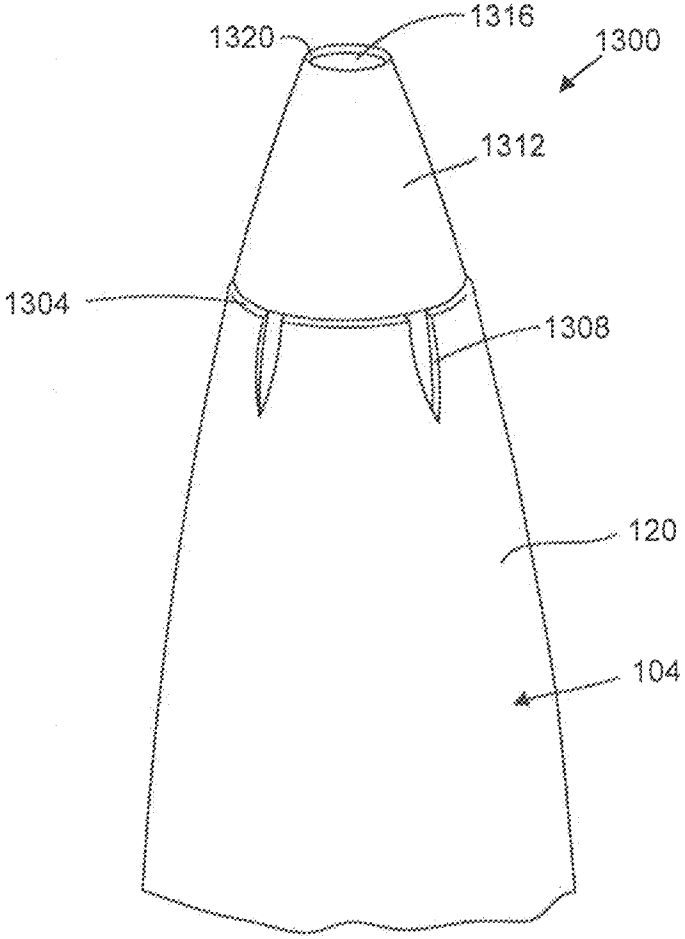
FIG. 13 depicts a perspective view of an expanding projectile according to one or more embodiments of the disclosure.

Referring to FIG. 13, a top perspective view of a nose of an expanding projectile 1300 is depicted, according to one or more embodiments. In various embodiments, expanding projectile 1300 can share one or more like elements with expanding projectile 100 of FIG. 1. As such, like elements are referred to with the same reference numbers For example, expanding projectile 1300 is jacketed, including a projectile body 104 composed of a metal jacket 120 extending from a tail portion to an annular forward end 1304 and surrounding an interior solid core. In various embodiments, the forward end 1304 of the metal jacket 120 includes one or more skives 1308 or longitudinal cuts for improved expansion upon projectile impact.

In one or more embodiments, projectile 1300 includes a tip 1312. In various embodiments, tip 1312 can include a forward central opening 1316 defined by an annular forward edge 1320 at a forward most portion of the tip 1312. Described further below, in various embodiments the central opening 1316 of the tip 1312 is a recess end point for an axial recess that extends through the tip 1300 to expose a forward facing interior surface of the projectile 1300.

Figure 14A:
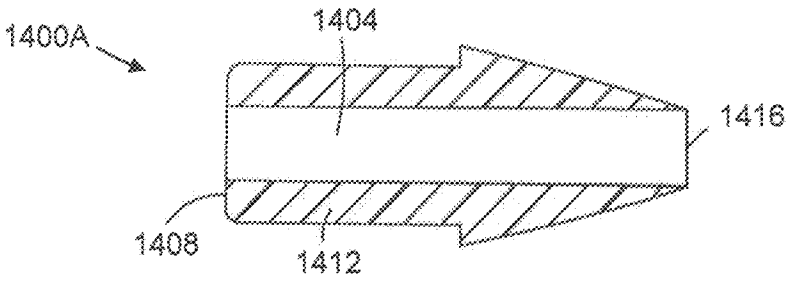
Figure 14B:
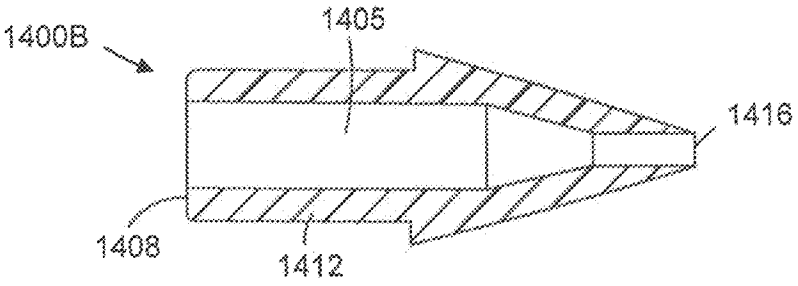
Figure 14C:
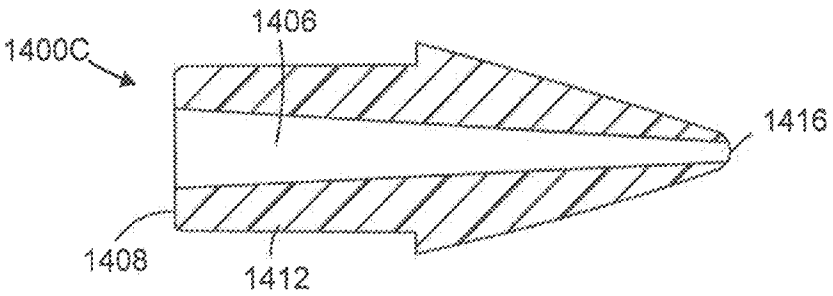

For example, referring to FIGS. 14A-14G, various designs of a tip including one or more axial recesses that extend through the length of the tip are depicted, according to one or more embodiments. Referring to FIG. 14A-14C, a tip 1400A, 1400B, 1400C includes a centrally located axial recess 1404, 1405, 1406 that extends from a rear end 1408 of a tip retention portion 1412 to a recess end point 1416 at the forward most point of the tip 1400A, 1400B, 1400C. As such, axial recess 1404, 1405, 1406 defines a central through-hole in the tip 1400A, 1400B, 1400C that, when mounted in an expanding projectile, provides a fluid passageway through to various interior surfaces.

Referring to FIG. 14D, in various embodiments, a tip 1400D, includes a plurality of axial recesses 1418 that extends from a rear end 1408 of a tip retention portion 1412 to a recess end point 1420 at the forward most point of the tip 1400D. As such, axial recess 1418 defines a central through-hole in the tip 1400D that, when mounted in an expanding projectile, provides a fluid passageway through to various interior surfaces. Depicted in FIGS. 14E-14G, in various embodiments, the tip 1400D can include a variety of axial recesses. For example, tip 1400E includes four axial recesses 1418, while tips 1400F and 1400G includes three and six axial recesses 1418 respectively. In various embodiments the tip 1400D can include fewer or greater number of axial recesses 1418.

Figure 15:
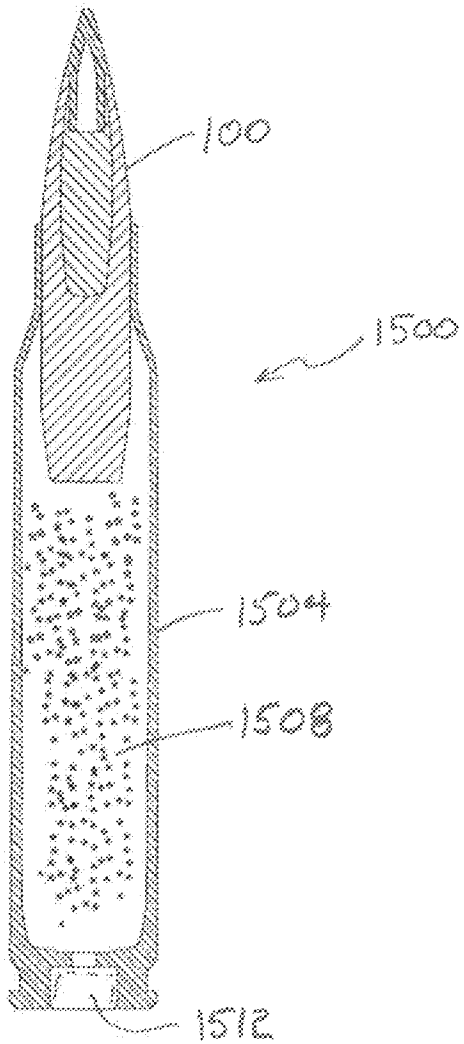
FIG. 15 depicts a cross section view of a cartridge for an expanding projectile, according to one or more embodiments of the disclosure.

Referring to FIG. 15 a cartridge 1500 including an expanding projectile 100 is depicted, according to one or more embodiments of the disclosure. In various embodiments, the cartridge 1500 includes casing 1504, propellant 1508, and a primer 1512. Seen in FIG. 15, casing 1504 is sized to contact a portion of projectile 100, such that when fired, the projectile 100 is launched from the casing 1504 and directly engages with a rifled barrel of a projectile delivery system.

Figure 16A:
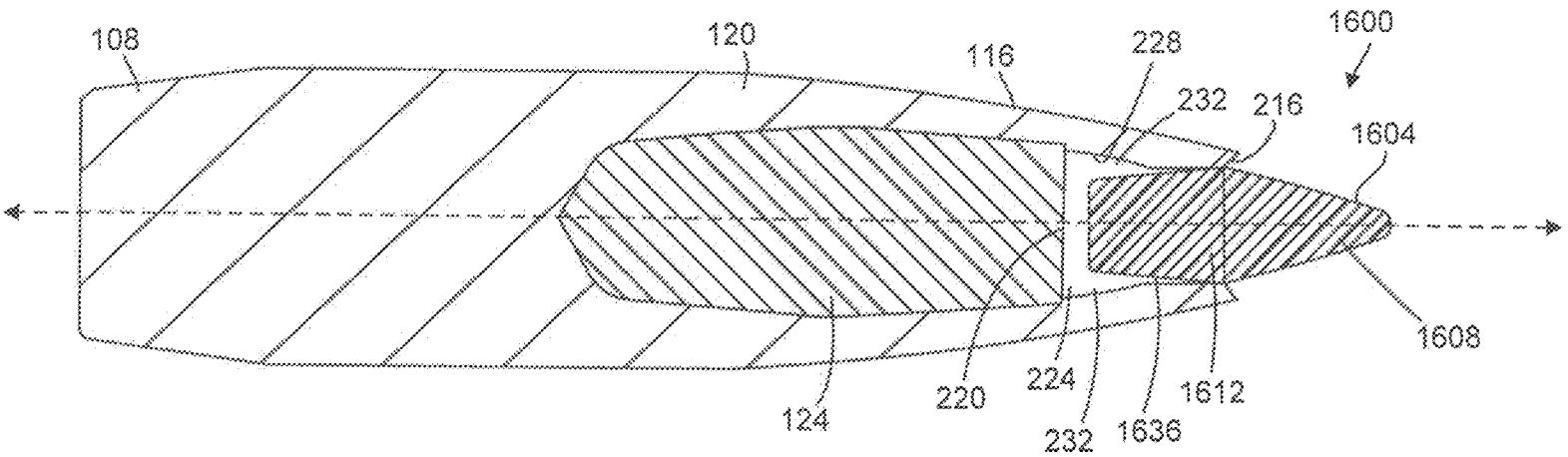
FIGS. 16A-16B depict cross sectional views of tips, according to one or more embodiments of the disclosure.
Figure 16C:
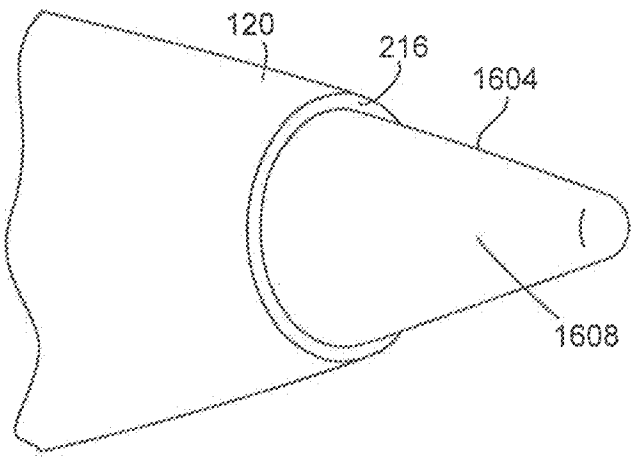
FIG. 16C depicts a perspective view of a tip, according to one or more embodiments of the disclosure.
Figure 16B:
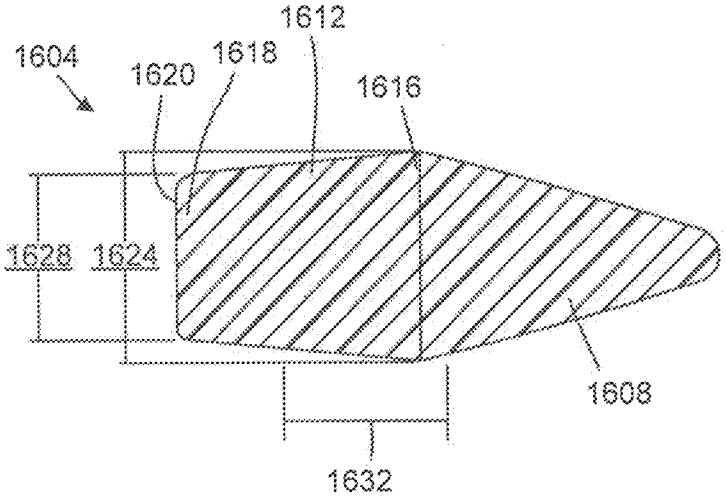

Referring to FIGS. 16A-16C, cross-section views and a perspective view of an expanding projectile 1600 and a projectile tip 1604 are depicted, according to one or more embodiments of the disclosure. In various embodiments, expanding projectile 1600 shares one or more like elements with the expanding projectile 200 of FIG. 2A. As such, like elements are referred to with the same reference numbers. Expanding projectile 1600 is jacketed, having a metal jacket 120 extending from the tail portion 108 to the nose portion 116 and surrounding an interior solid core 124. The metal jacket 120 extends to an annular forward edge 216 that defines an opening in the metal jacket 120 to expose a forward facing interior surface 220 of the interior solid core 124.

In one or more embodiments, the expanding projectile 1600 includes a central cavity 224 extending from the opening defined by the annular forward edge 216 to the forward facing interior surface 220. In certain embodiments, the central cavity 224 has an undercut shape, as the metal jacket 120 tapers from the forward facing interior surface 220 to the opening such that the opening has a diameter smaller than that of the width of the forward facing interior surface 220 and defines undercut corner regions 232.

In one or more embodiments, the tip 1604 defines a most forward tip for the projectile 1600. The tip 1604 is a unitary structure including a main portion 1608 and a tip retention portion 1612 rearward of the main portion 1608 and opening. As described above, in various embodiments the tip retention portion 1612 is a plug element that, when assembled in the central cavity 224, resists axial movement of the tip 1604 and retains it in place in the projectile 1600.

In one or more embodiments, tip retention portion 1612 tapers rearwardly from a forward portion 1616, adjacent to the main portion 1608, to a rearward portion 1618 adjacent a rearwardly facing end surface 1620 of the tip 1604. For example, tip retention portion 1612 has a first width 1624 at the forward portion 1616 and a second smaller width 1628 at the rearward portion 1618. In various embodiments the second width 1628 is approximately 10% smaller than the first width 1624. In certain embodiments the second width 1628 is approximately 5% to 20% smaller than the first width 1624. In certain embodiments the first width is approximately 20% to 50% smaller than the first width 1624. In various embodiments, the first width 1624 defines the outermost width of the tip. In addition, in certain embodiments the first width 1624 is sized such that the tip fits or couples to the remainder of the projectile 1600 via a friction fit or interference fit with the metal jacket 120 at the opening.

As such, in one or more embodiments, tip retention portion 1612 includes a fracture region 1632 defined by the tapered shape of the tip retention portion 1612. Fracture region 1632 is a portion of the tip 1604 that is configured to fracture or deform upon impact of the projectile 1600 with a target, as described above, thereby providing a fluid pathway into the central cavity 224 and exposing the forward facing interior surface 220. In various embodiments the fracture region 1632 is defined by the tapered shape of the tip retention portion 1612. For example, the tapered shape provides a weak point in the coupling between the tip 1604 and the remainder of the projectile 1600 in the form of a void 1636 between the metal jacket 120 and the tip retention portion 1612 for the main portion 1608 of the tip to deform or break off.

In one or more embodiments, the fracture region 1632 is configured to fracture or deform at impact energies associated with velocities as low as 1500 feet per second. In some embodiments, the fracture region 1632 is configured to fracture or deform at impact energies associated with velocities as low as 1000 feet per second. For example, in certain embodiments, the fracture region 1632 is configured to fracture or deform at impact energy as low as 800 foot pounds. However, in various embodiments, fracture regions can be designed to fracture at higher or lower impact velocities or with various energy requirements based on the structural strength of the fracture region.

Figure 17A:
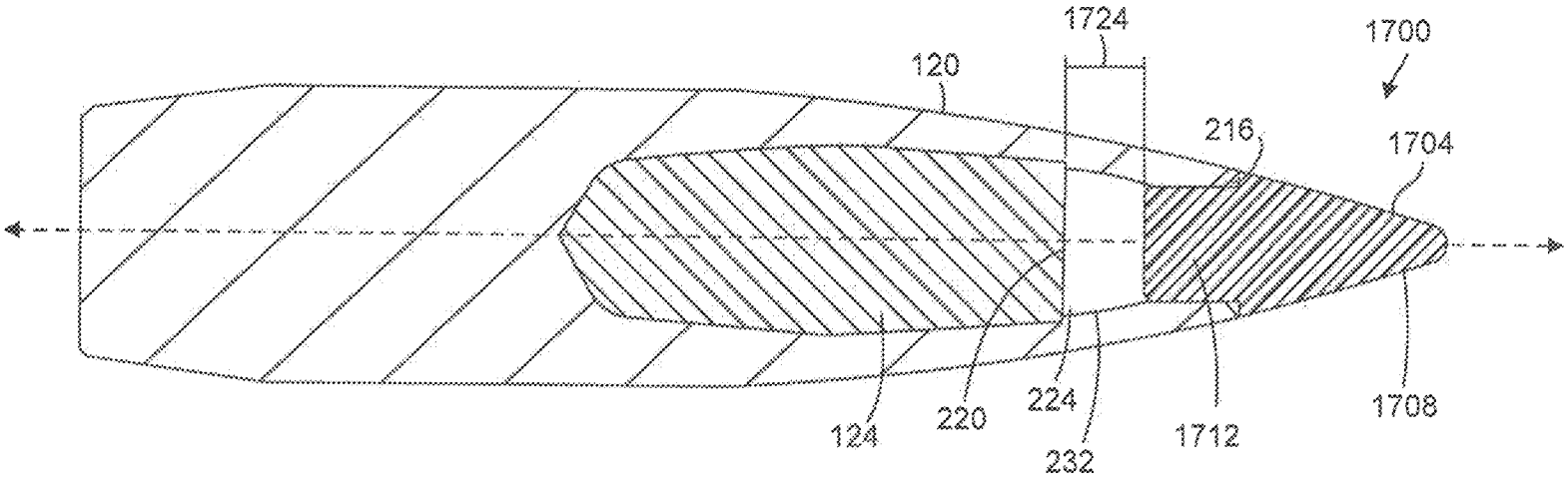
FIGS. 17A-17B depict cross sectional views of a tip, according to one or more embodiments of the disclosure.
Figure 17B:
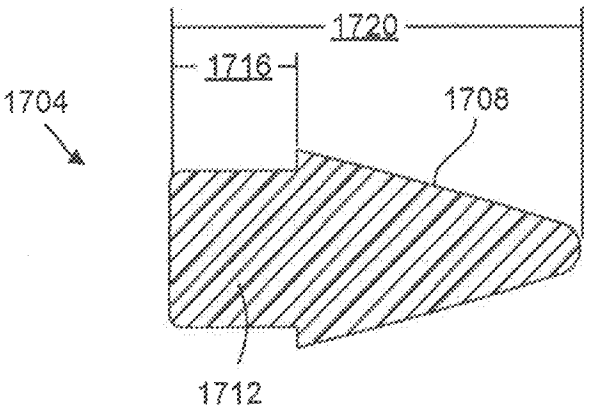

Referring to FIGS. 17A-17B, cross-section views of an expanding projectile 1700 and a projectile tip 1704 are depicted, according to one or more embodiments of the disclosure. In various embodiments, expanding projectile 1700 shares one or more like elements with the expanding projectile 200 of FIG. 2A. As such, like elements are referred to with the same reference numbers. In one or more embodiments, the expanding projectile 1700 includes a central cavity 224 extending from the opening defined by the annular forward edge 216 to the forward facing interior surface 220. In certain embodiments, the central cavity 224 has an undercut shape, as the metal jacket 120 tapers from the forward facing interior surface 220 to the opening such that the opening has a diameter smaller than that of the width of the forward facing interior surface 220 and defines undercut corner regions 232.

In one or more embodiments, the tip 1704 defines a most forward tip for the projectile 1700. The tip 1704 is a unitary structure including a main portion 1708 and a tip retention portion 1712 rearward of the main portion 1608 and opening. As described above, in various embodiments the tip retention portion 1612 is a plug element that, when assembled in the central cavity 224, resists axial movement of the tip 1704 and retains it in place in the projectile 1700.

In various embodiments the tip retention portion 1712 is shortened, having a first length 1716 that is between 10% to 40% of a total bullet length 1720 including the tip 1704. In various embodiments, this shortened tip retention portion 1712 provides a void 1724 between the forward facing interior surface 220 and the tip 1704. As a result, the tip 1704 is not supported axially by the interior surface 200 and is supported solely by the metal jacket of the projectile 1700. In various embodiments this allows the tip to, upon impact, telescope into the central cavity 224 upon impact with a target, thereby providing a fluid pathway to the central core 124.

Figure 18:
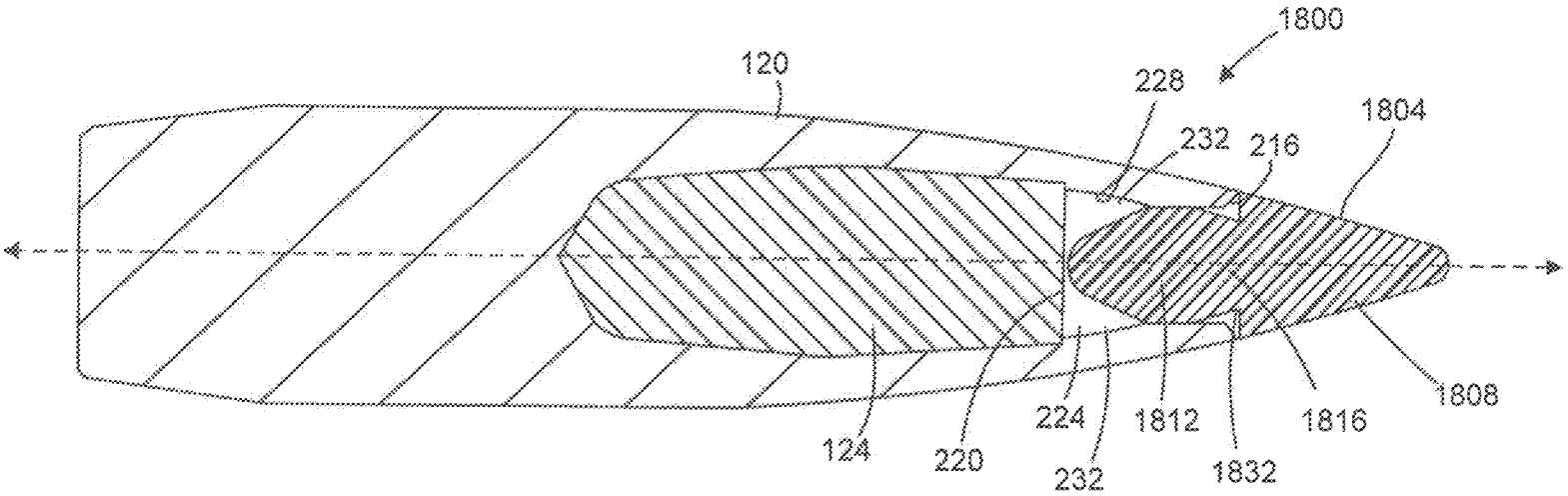
FIG. 18 depicts a cross sectional view of a tip, according to one or more embodiments of the disclosure.

Referring to FIG. 18 a cross-section view an expanding projectile 1800 and projectile tip 1804 is depicted, according to one or more embodiments of the disclosure. In various embodiments, expanding projectile 1800 share one or more like elements with the expanding projectile 200 of FIG. 2A. As such, like elements are referred to with the same reference numbers. Expanding projectile 1800 is jacketed, having a metal jacket 120 extending to an annular forward edge 216 that defines an opening in the metal jacket 120 to expose a forward facing interior surface 220 of the interior solid core 124.

In one or more embodiments, the expanding projectile 1800 includes a central cavity 224 extending from the opening defined by the annular forward edge 216 to the forward facing interior surface 220. In certain embodiments, the central cavity 224 has an undercut shape, as the metal jacket 120 tapers from the forward facing interior surface 220 to the opening such that the opening has a diameter smaller than that of the width of the forward facing interior surface 220 and defines undercut corner regions 232.

In one or more embodiments, the tip 1804 defines a most forward tip for the projectile 1800. The tip 1704 is a unitary structure including a main portion 1808 and a tip retention portion 1812 rearward of the main portion 1808 and opening. As described above, in various embodiments the tip retention portion 1812 is a plug element that, when assembled in the central cavity 224, resists axial movement of the tip 1804 and retains it in place in the projectile 1600.

In one or more embodiments, tip retention portion 1812 at a forward portion 1816, adjacent to the main portion 1808. As a result, tip retention portion 1812 has a reduced width at the forward portion 1816. In various embodiments the width at the forward portion is reduced approximately 10% as compared to the wider portions of the tip retention portion 1812. In certain embodiments the reduced width is approximately 5% to 20% smaller. In certain embodiments the reduced width is 20% to 50% smaller.

In various embodiments, the width at the forward portion 1816 defines a fracture region 1832 defined by the tapered shape of the tip retention portion 1812. Fracture region 1832 is configured to fracture or deform upon impact of the projectile 1800 with a target, as described above, thereby providing a fluid pathway into the central cavity 224 and exposing the forward facing interior surface 220. In one or more embodiments, the fracture region 1832 is configured to fracture or deform at impact energies associated with velocities as low as 1500 feet per second. In some embodiments, the fracture region 1832 is configured to fracture or deform at impact energies associated with velocities as low as 1000 feet per second. For example, in certain embodiments, the fracture region 1832 is configured to fracture or deform at impact energy as low as 800 foot pounds. However, in various embodiments, fracture regions can be designed to fracture at higher or lower impact velocities or with various energy requirements based on the structural strength of the fracture region.

Figure 19:
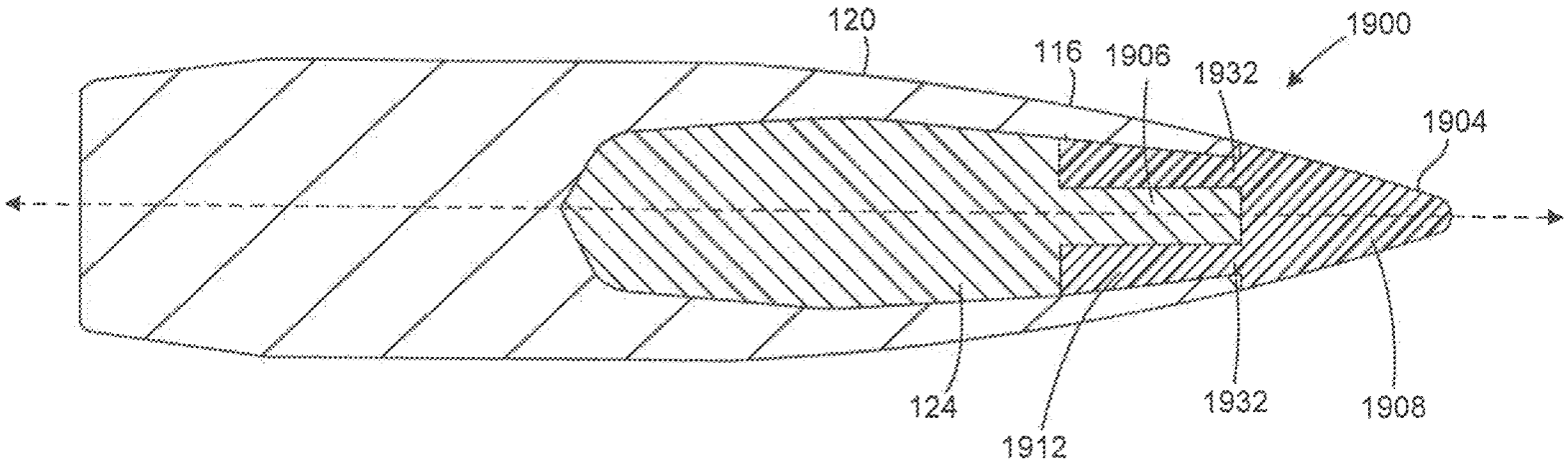
FIG. 19 depicts a cross sectional view of a tip, according to one or more embodiments of the disclosure.

Referring to FIG. 19 a cross-sectional view of an expanding projectile 1900 with tip 1904 is depicted, according to one or more embodiments. In certain embodiments, projectile 1900 includes an interior solid core 124 having a forwardly extending central stub 1906. In various embodiments, the central stub 1906 is axially centered and extends forward to the forward opening of the projectile 1900 as defined by the metal jacket 120. In certain embodiments the central stub extends to be flush with the forward opening.

In various embodiments the tip 1904 is injection molded or insert molded onto the projectile 1900. As a result the polymer material of the tip 1904 fills the area surrounding the central stub 1906 as well as the volume outside of the bullet—to form the tip 1904. As a result, the tip 1904 defines an annular tip retention portion 1912 surrounding the central stub 1906 and that is rigidly locked to the bullet. In addition, as a result of the tapered shape of the metal jacket at the nose portion 116, the molding process defines a fracture region 1932 of thinner material near the main portion 1908. In various embodiments the fracture region 1932 is thinner to promote breakage upon impact, as described above.

Figure 20A:
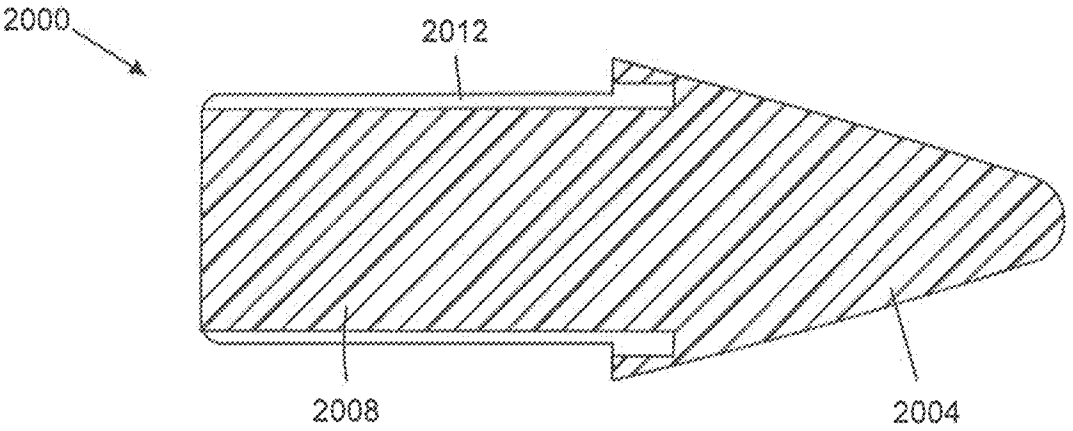
FIGS. 20A-20B depict a cross sectional view and a rear view of a tip, according to one or more embodiments of the disclosure.
Figure 20B:
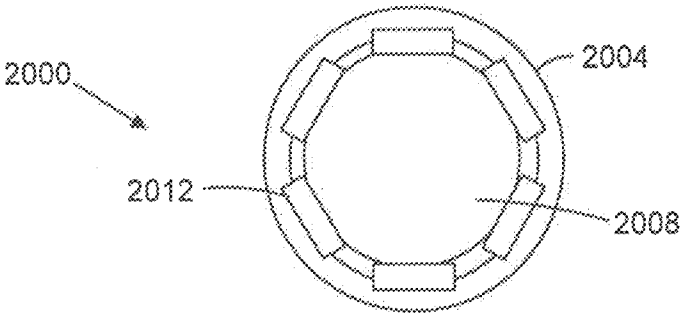

Referring to FIGS. 20A-20B a tip 2000 is depicted having a main portion 2004 and a tip retention portion 2008. In one or more embodiments, tip retention portion 808 includes a plurality of axially extending recesses 2012 which are distributed circumferentially about the exterior of the tip retention portion 2008. Depicted in FIGS. 20A & 20B, six recesses 2012 are shown, however, in various embodiments fewer or greater amounts could be included in the tip retention portion 2008 based on the preferred design.

As a result of the recesses 2012, a fracture region is defined in the tip retention portion 2008, as the tip retention portion 808 is configured to either deform or fracture upon impact to expose one or more openings into the axial recesses 2012, which would expose interior surfaces of an expanding projectile, as described above.

Figure 21:
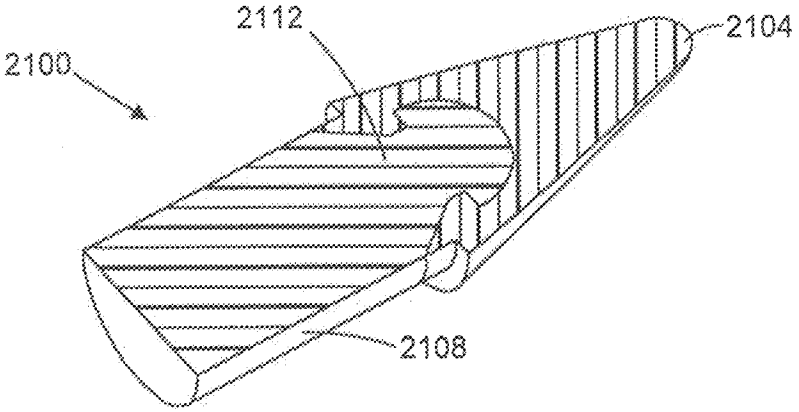
FIG. 21 depicts a cross sectional view of a tip, according to one or more embodiments of the disclosure.
Figure 22:
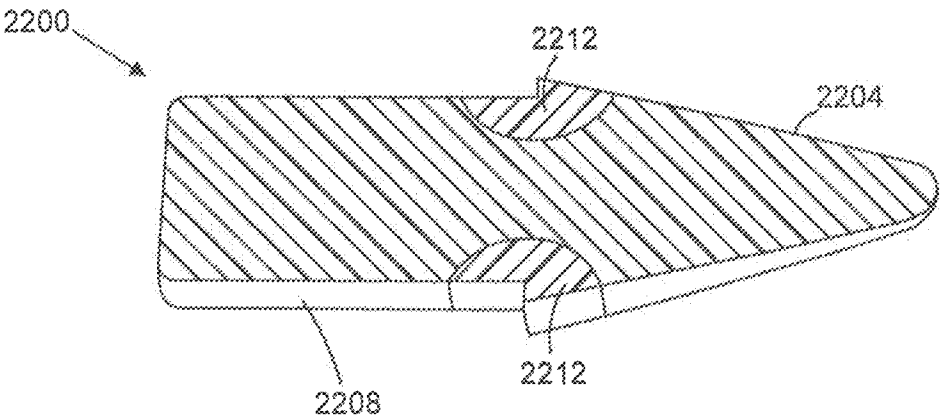
FIG. 22 depicts a cross sectional view of a tip, according to one or more embodiments of the disclosure.

Referring to FIGS. 21-22 tips 2100, 2200 are depicted having a main portion 2104, 2204 and a tip retention portion 2108, 2208. In one or more embodiments, tip 2100, 2200 are constructed using multiple materials. For example, tip retention portion 2108, 2208 is constructed, in certain embodiments, of a first material, while the main portion 2104, 2204 is constructed from a first material. In various embodiments the main portion and tip retention portion are constructed using a two-shot mold. In certain embodiments the first material is a generally harder material for resisting heat and providing robustness, while the second material is a softer material configured to fail upon impact and provide fluid passageways into the projectile as described above.

As a result of the molding processes, a fracture region 2112, 2212 is defined in the tip retention portions 2108, 2208, as the tip retention portion is configured to either deform or fracture upon impact.

Figure 23:
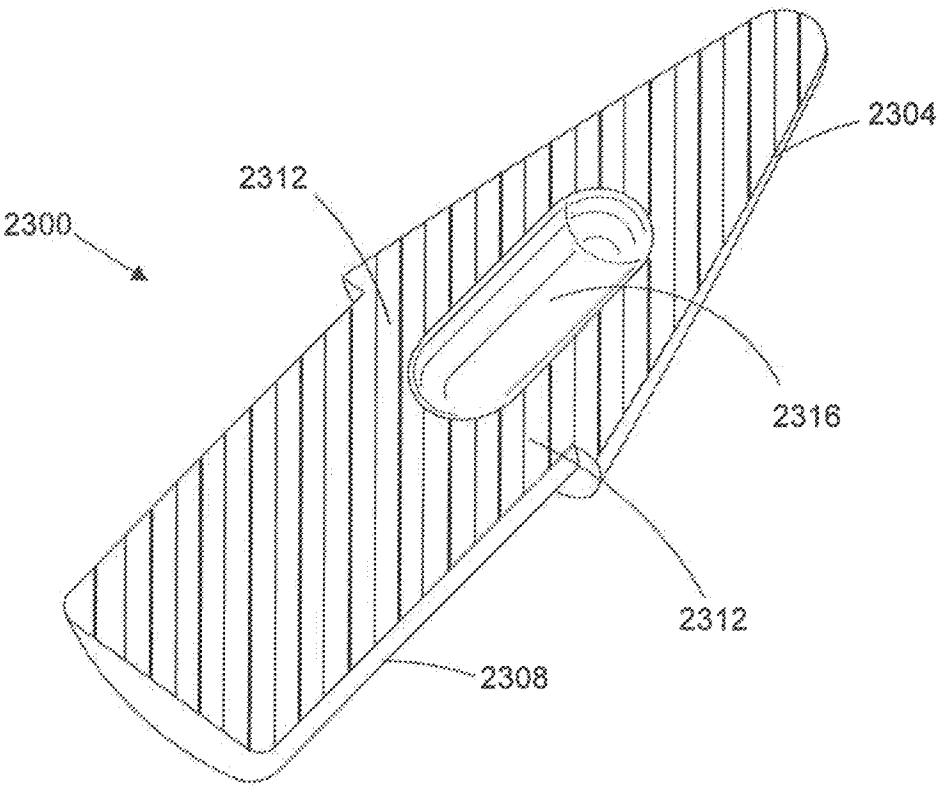
FIG. 23 depicts a cross sectional view of a tip, according to one or more embodiments of the disclosure.

Referring to FIG. 23 a tip 2300 is depicted having a main portion 2304 and a tip retention portion 2308. In one or more embodiments, tip 2300 includes a recesses 2316 defining a fracture region 2312 in the tip retention portion 2308 from structurally weakened areas resulting from the reduction of materials in the recess 2316. As a result of the fracture regions 2312 the tip retention portion 2308 is configured to either deform or fracture upon impact, as described above.

Figure 24:
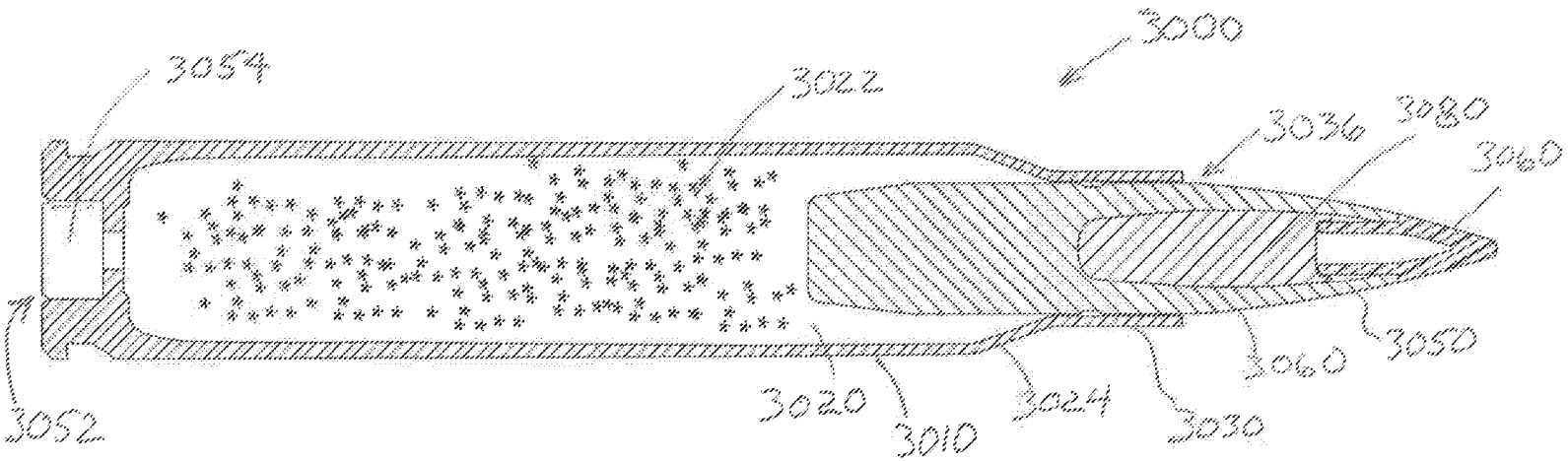
FIG. 24 depicts a cross sectional view of a cartridge according to embodiments.
Figure 25:
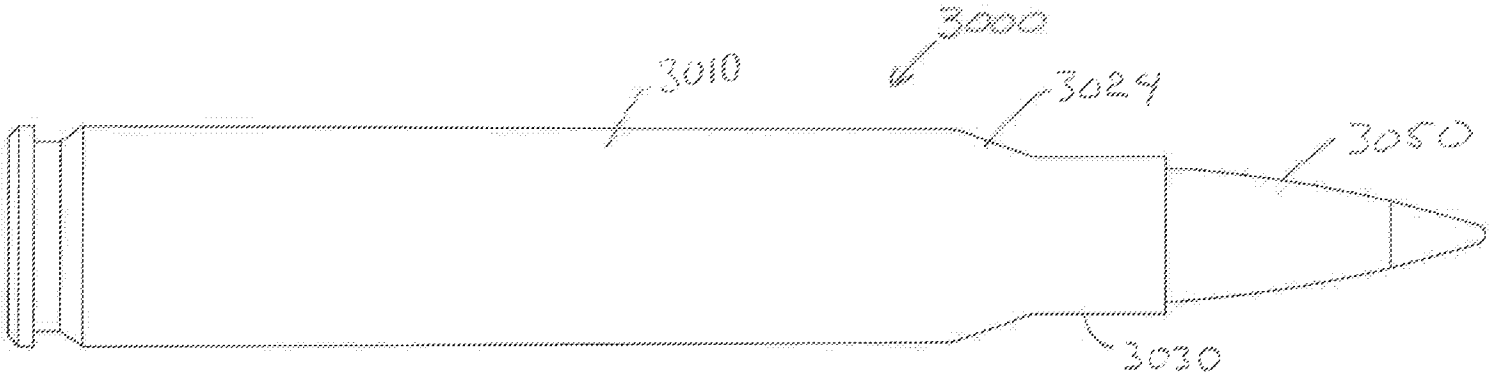
FIG. 25 depicts an elevational view of the embodiment of FIG. 24.
Figure 26:
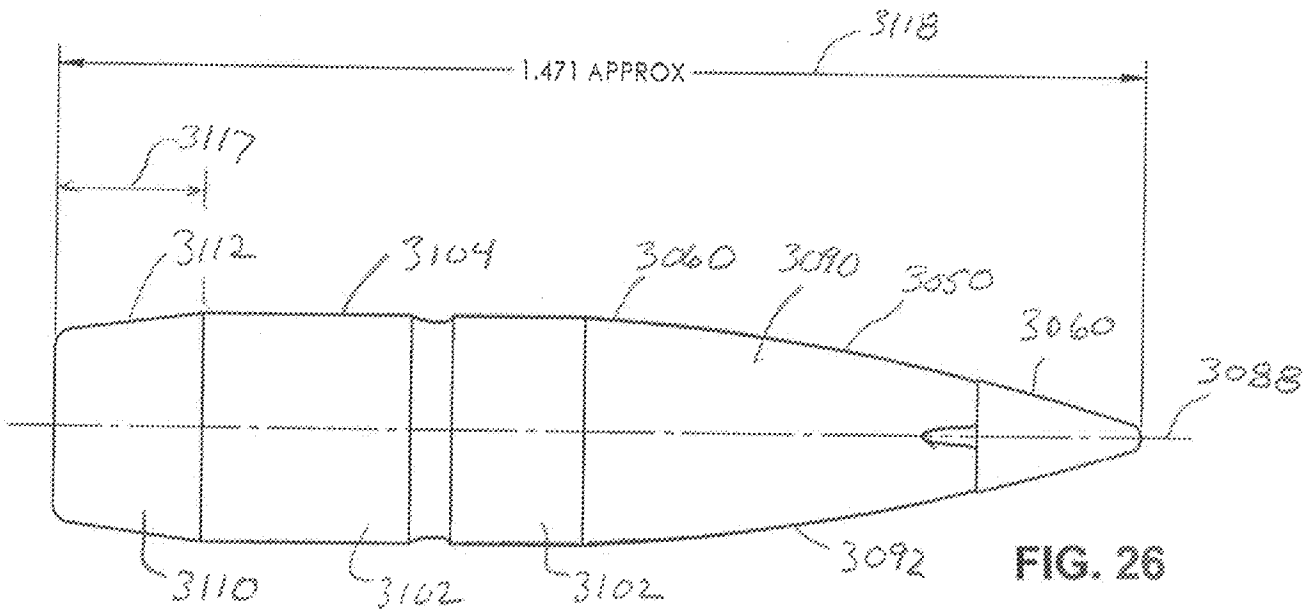
FIG. 26 depicts an elevational view of an embodiment of a bullet with an overall length dimension.
Figure 27:
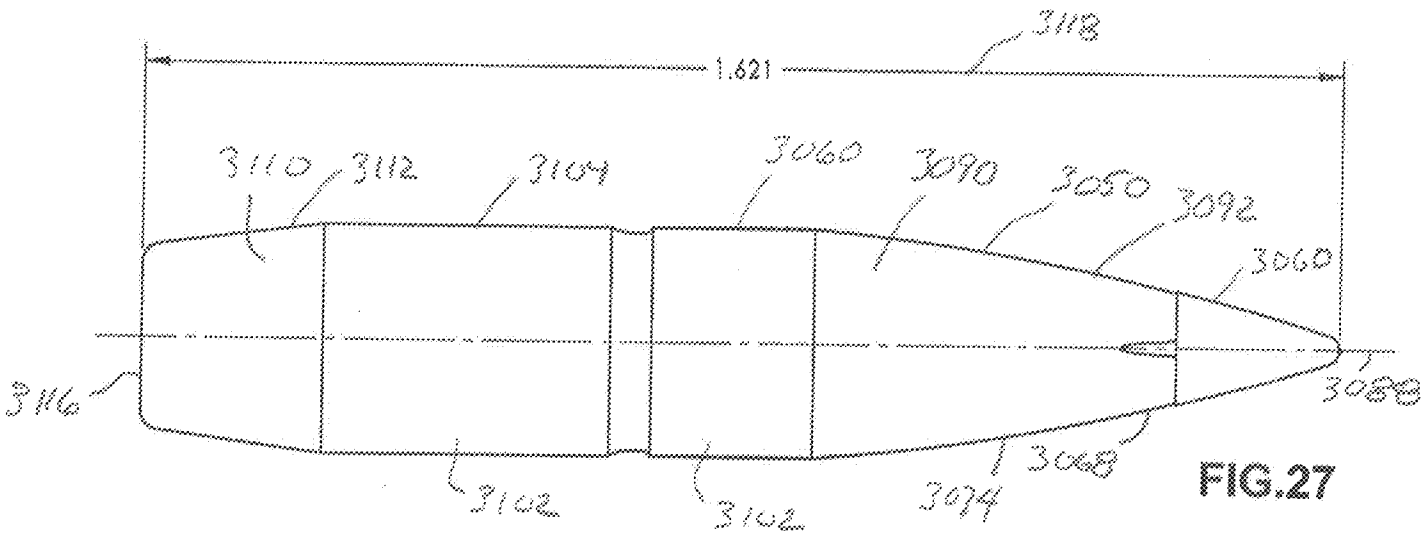
FIG. 27 depicts an elevational view of another embodiment of a bullet with an overall length dimension.
Figure 28A:
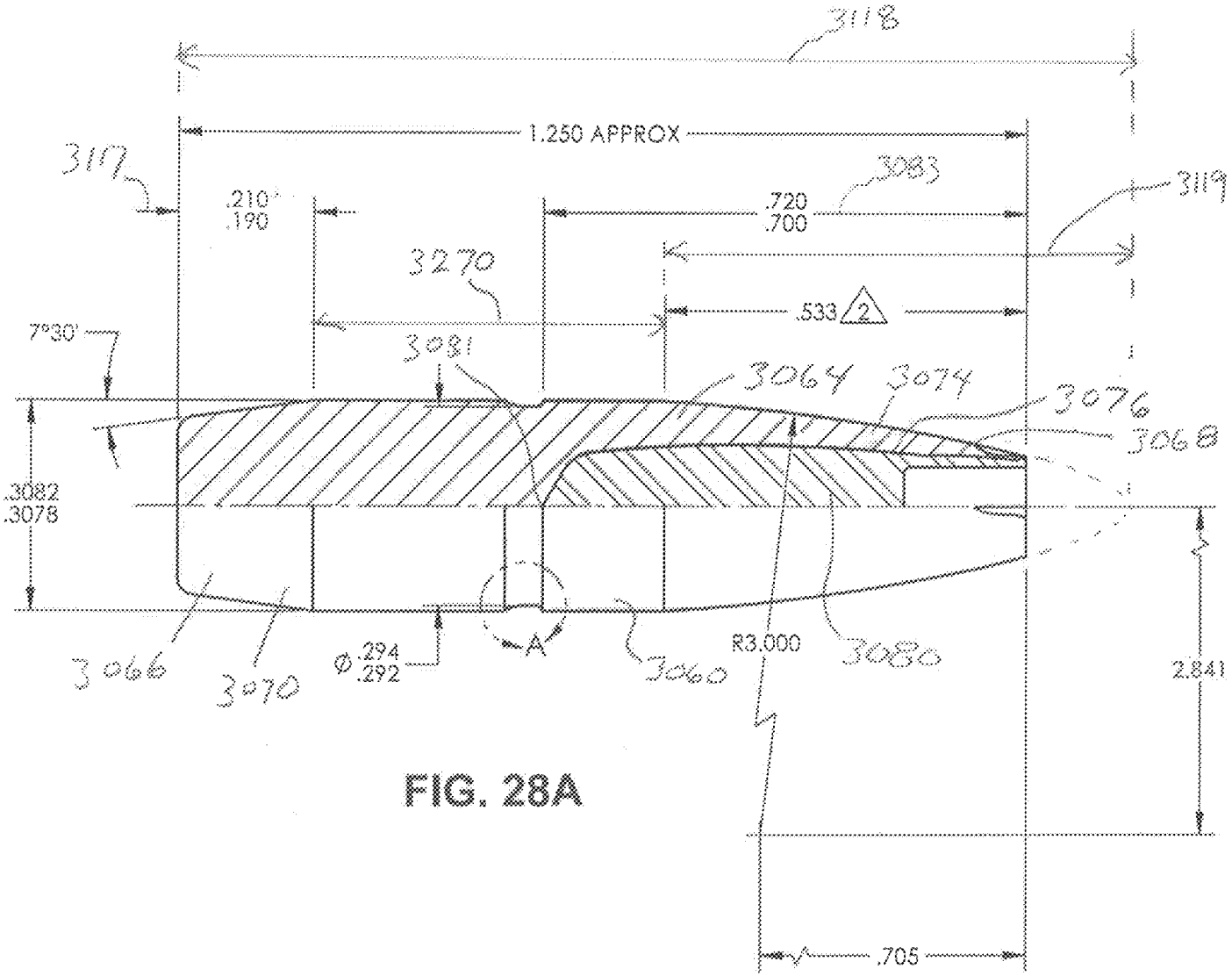
FIG. 28A depicts a cross-sectional view of a bullet body of the embodiment of FIG. 26 with detailed dimensions.
Figure 28B:
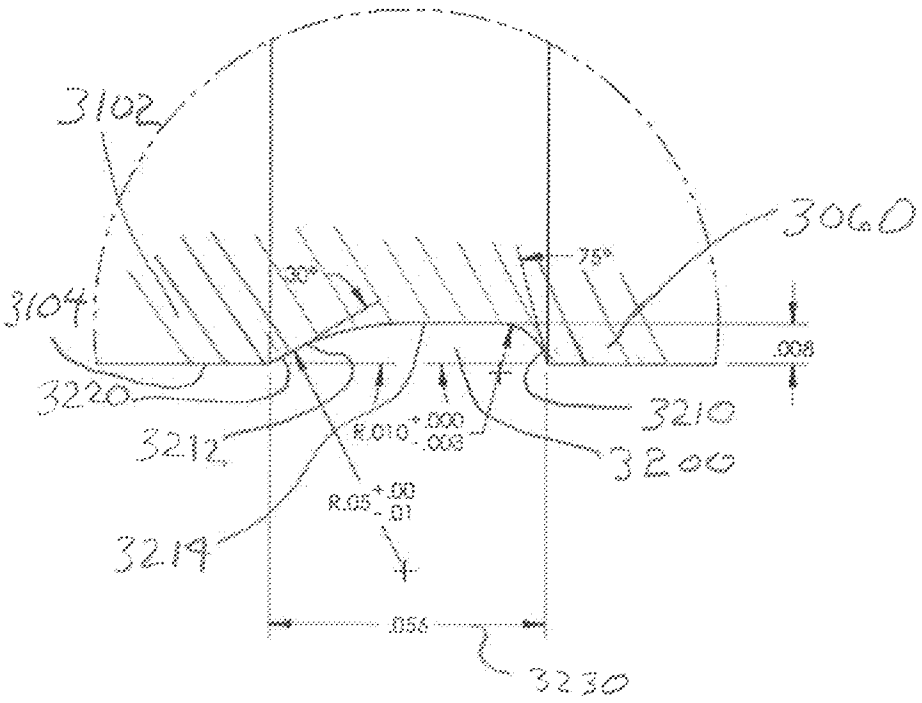
FIG. 28B depicts a detail of region "A" of FIG. 28A, an aerodynamically favorable circumferential groove in the jacket in accord with an embodiment.
Figure 29:
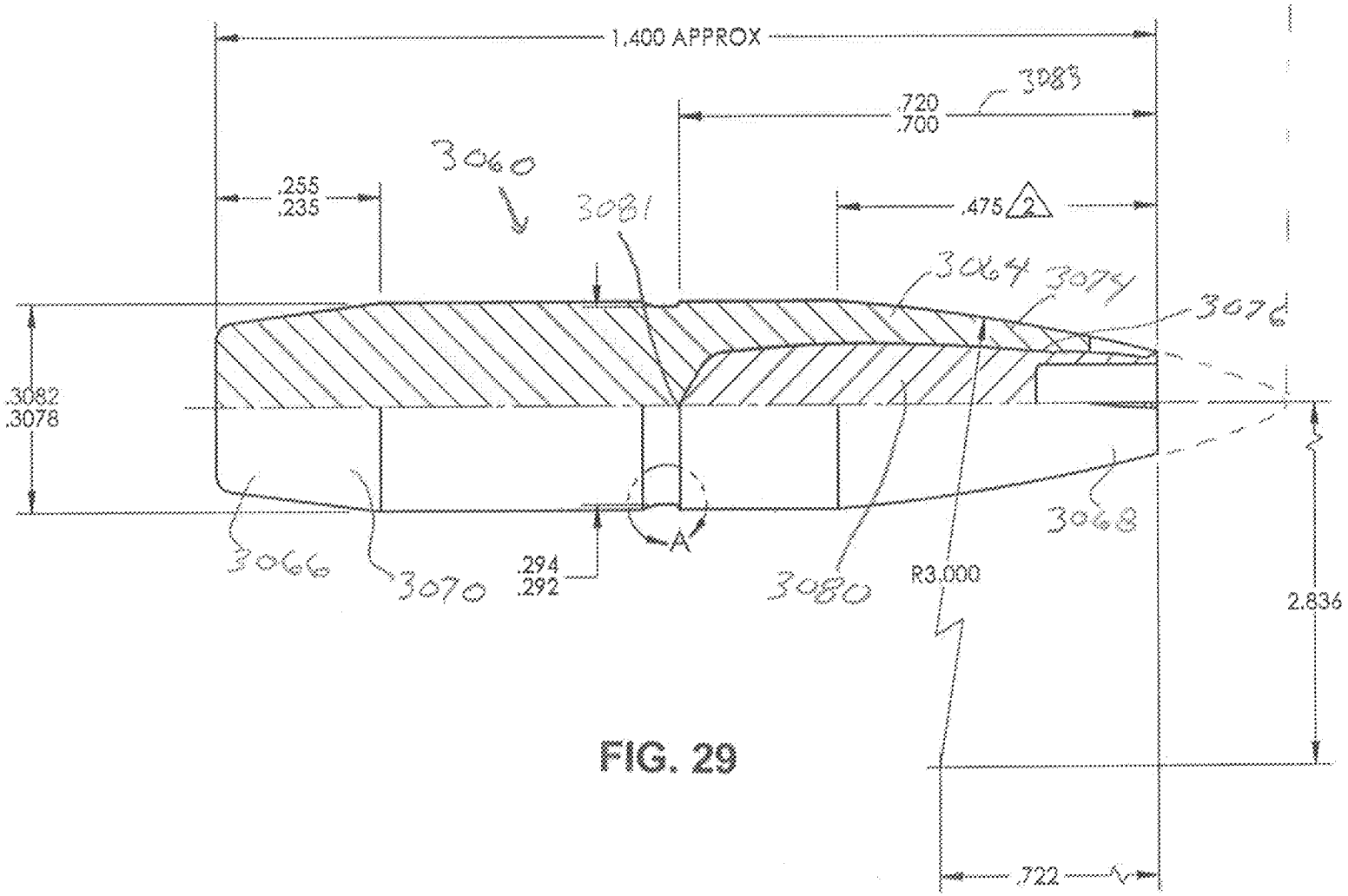
FIG. 29 depicts a cross sectional view of a bullet body of the embodiment of FIG. 27 with detailed dimensions.
Figure 30:
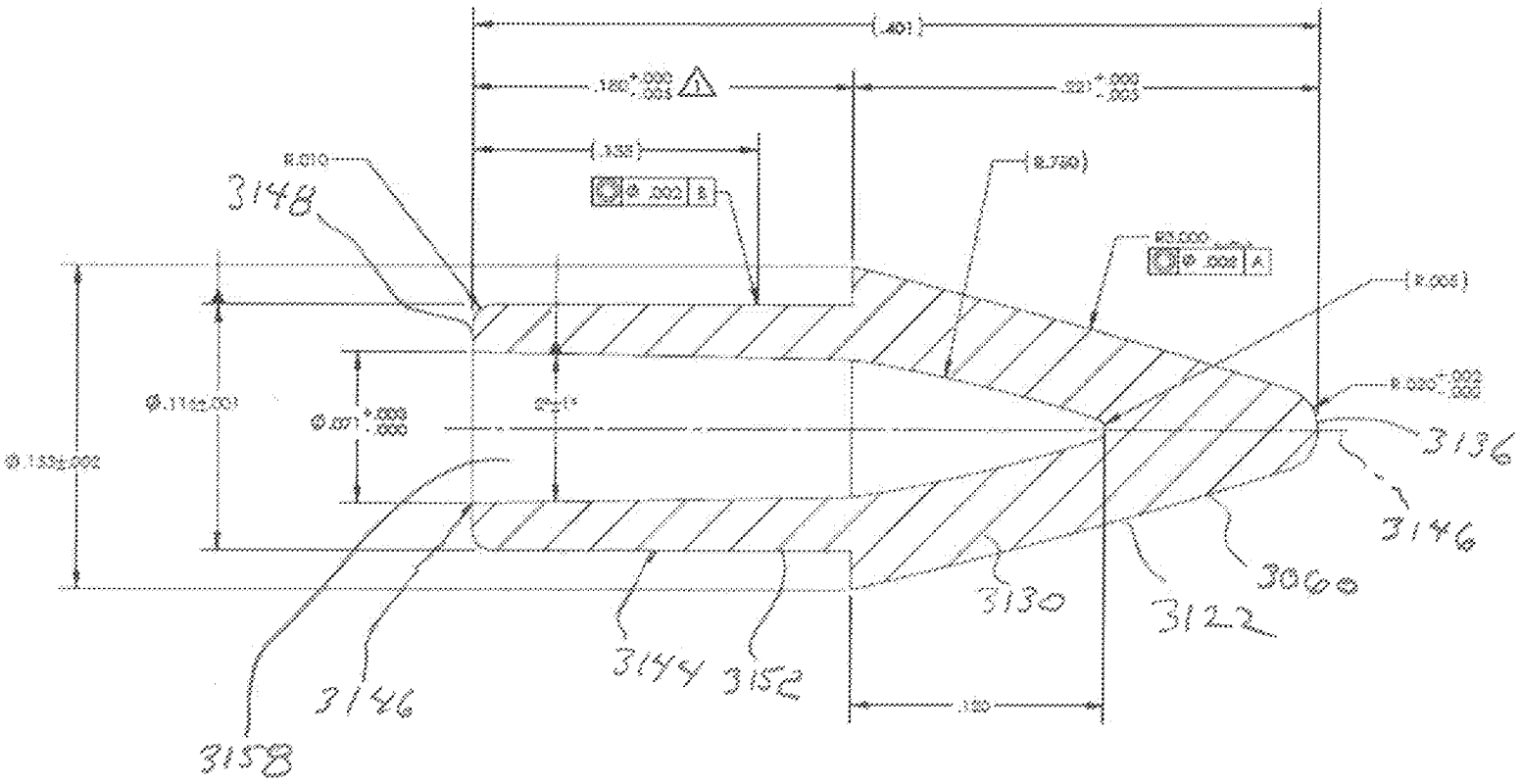
FIG. 30 depicts a cross sectional view of a tip in accord with embodiments along with suitable detailed dimensions.

Referring to FIGS. 24 and 25 another embodiment of a cartridge 3000 has a casing 3010 with an open interior 3020 with propellant 3022 therein, a casing shoulder 3024, a reduced diameter forward end 3030 defining a casing neck and a bullet receiving opening 3036 with a bullet 3050 therein, and a primer recess 3052 with a primer 3054 therein. Referring to FIGS. 24-30, the bullet 3050 having a bullet body 3060, the bullet body comprising a metal jacket 3064 extending from a tail portion 3066 to a nose portion 3068, having a solid heel portion 3070, and a forward jacket portion 3074 defining a core recess 3076 with a malleable core 3080 therein. The core extending Referring specifically to FIGS. 26-30, two configurations of exemplary bullets are illustrated which correlate with a 30 caliber 175 grain bullet and a 30 caliber 200 grain bullet. The bullet bodies have an axis 3088, a front ogival portion 3090 with an ogival surface 3092, a mid barrel engaging or bearing portion 3102 with a bearing surface 3104, a rearward boattail portion 3110 with a boattail surface 3112, and a rearward facing end surface 3116. In embodiments the boat tail extends an axial length 3117 greater than 12% of total length 3118 of the bullet including the tip.

A tip 3120 is inserted into the nose portion 3068 and has an axis an exterior surface 3122 that is substantially flush with the exterior surface 3092 of the ogival portion. The tip 3120 has a main portion configured as a tapered forward portion 3130 that may be conical or ogival with a rounded meplat 3136 and further has a tip retention portion configured as a stem portion 3144 unitary with the main portion. The stem portion 3144 having a rearward end 3146 with a rearward facing surface 3148, an exterior circumferential surface 3152. The tip body defines a hollow core 3158 that extends from the rearward end 3146 of the stem portion 3144 forwardly and may extend into the main portion 3130. The hollow core may be configured as a bore and may have other shapes as well. The stem with the hollow core being tubular.

Referring to FIGS. 24-29 and particularly 28B, the bullet body 3060 at the bearing portion 3102 defining a circumferential groove 3200. The bearing portion at the groove having a forward wall portion 3210 and a rearward wall portion 3212 and a bottom wall portion 3214. The rearward wall having a chamfer or lead-in surface or ramp 3220 from the bottom wall portion to the exterior bearing surface 3104 of the bearing portion 3102. In embodiments the ramp 3220 has an angle of from 20 to 45° measured from a line on the outer surface of the body portion parallel to the bullet axis with the 20 to 45° angle facing forward. FIG. 28B illustrates an angle of 30°. In embodiments the ramp is from 18 to 34° as measured above. In embodiments the ramp can extend a distance of 30 to 40% of the axial length 3230 of the groove 3200. In embodiments the ramp can extend a distance of 30 to 70% of the axial length 3230 of the groove 3200. In embodiments the groove has a maximum depth of 0.008 inches±20%. The circumferential groove reduces the bearing surface contact area and may provide a pedaling stop. See U.S. Pat. No. 6,439,125; incorporated by reference herein for all purposes.

Referring to FIGS. 26-29, in embodiments, the groove is positioned in the forward half of the bearing portion 3102 lengthwise and is positioned in the rearward half of the bullet body lengthwise. The placement is the forward half of the bearing surface is believed to provide better sealing of the propellant gases during obturation as compared to a more rearwardly positioned groove. The groove is also position in embodiments at the rearward end axially of the core. The groove may provide an axial stop to the pedaling and positioning the groove at this point allows substantially full upsetting of the malleable core material. The groove does not impede the mushrooming of the core.

In embodiments, the bearing portion extends a length 3270 that is 44% or less of the total bullet length 3118. In embodiments, the bearing portion extends a length 3270 that is 37% or less of the total bullet length 3118. In embodiments, the length of the ogive portion and tip 3119 is greater than 40% of the total bullet length 3118. In embodiments, the length of the ogive portion and tip 3119 is greater than 45% of the total bullet length 3118. In embodiments, the length of the ogive portion and tip 3119 is greater than 50% of the total bullet length 3118.

Figure 32:
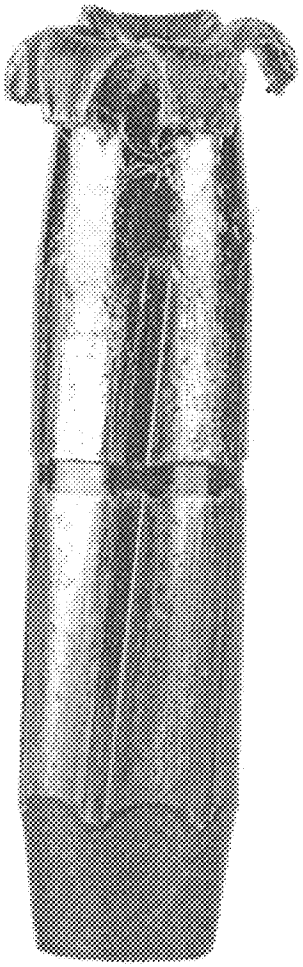
FIG. 32 depicts a bullet in accord with embodiment after impact with a test gel at 1350 feet per second which can equate to a downrange distance of greater than 900 yards.
Figure 31:
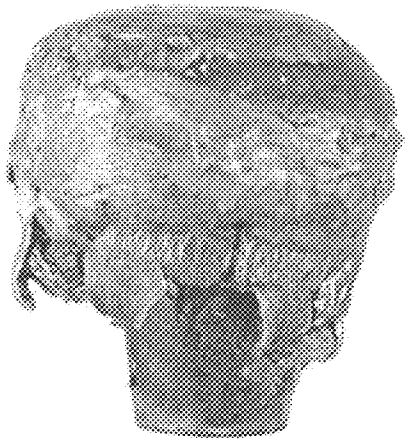
FIG. 31 depicts a bullet embodiment after impact with a test gel at 2740 feet per second which can equate to a downrange distance of 50 yards.

Referring to FIGS. 31 and 32, images of terminal effects, the deformation of a bullet in accord with the inventions herein are illustrated. The image of FIG. 31 reflects the terminal effects at 2740 feet per second, which equates to a 200 grain 300 Winchester Magnum load with the bullet impacting test gel at about 50 yards. The image of FIG. 32 reflects the terminal effects of the same load with the bullet impacting test gel at a distance greater than 900 yards and with a velocity of about 1350 feet per second. Such a consistent mushrooming has not been available at such a range of distances. Referring to FIGS. 26-30, these velocities and terminal performances were obtained using the configurations herein. The dimensioned configurations set forth specific embodiments of the inventions not inclusive, of course, with all embodiments. In embodiments, the dimensions may vary ±3% of the dimensions in FIGS. 26-30. In embodiments, the dimensions may vary ±6% of the dimensions in FIGS. 26-30. In embodiments, the dimensions may vary ±10% of the dimensions in FIGS. 26-30.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A cartridge, comprising:

a casing comprising a rearward primer, propellant, and a bullet, the bullet comprising:

a bullet body including a boattail portion, a bearing portion extending an axial length of 44% or less than total length of the bullet, and an ogival portion extending an axial length of greater than 40% of the total length of the bullet;

the bearing portion comprising at least one circumferential groove comprising a forward wall portion, a bottom wall portion, and a rearward wall portion;

the rearward wall portion comprising a ramp extending between the bottom wall portion and an exterior surface of the bearing portion comprising a forward facing angle in the range of 18° to 45° measured from a line on the outer surface of the bearing portion parallel to a bullet axis, and the ramp extending a distance in the range of 30 to 70% of the axial length of the groove;

the at least one circumferential groove further comprising a depth of up to about 0.008 inches±20%.

2. The cartridge of claim 1, wherein the forward facing angle is in the range of 18° to 34°.

3. The cartridge of claim 1, wherein the ramp extends a distance in the range of 30 to 40% of an axial length of the at least one circumferential groove.

4. The cartridge of claim 1, wherein the ogival portion comprises a forward opening comprising a polymer tip extending therefrom.

5. The cartridge of claim 1 further comprising the at least one circumferential groove at a forward half of the bearing portion and a rearward half of the bullet body.

6. The cartridge of claim 1, wherein the bullet body further comprises a malleable core extending towards the forward opening.

7. The cartridge of claim 6, wherein the at least one circumferential groove is axially positioned at a rearward end of the malleable core and a forward portion of the bearing portion.

8. The cartridge of claim 1 comprising the bearing portion extending an axial length of 37% or less than total length of the bullet.

9. The cartridge of claim 1, the ogival portion comprising a forward opening and a polymer tip extending therefrom comprising a tubular stem.

10. The cartridge of claim 9, the ogival portion further comprising a plurality of circumferential skives extending rearwardly from the forward opening.

11. The cartridge of claim 9, the ogival portion and tip extending an axial length of greater than 45% of the total length of the bullet.

12. The cartridge of claim 9, the ogival portion and tip extending an axial length of greater than 50% of the total length of the bullet.

13. The cartridge of claim 9, the tip comprising a main portion and a tip retention portion comprising the stem, the tip further comprising a hollow core.

14. The cartridge of claim 9 wherein the polymer tip comprises:

a main portion and a tip retention portion comprising the stem, the main portion comprising a conical or an ogive shape extending from wider rearward portion to a tapered forward most tip, the tip retention portion connected to the rearward portion and extending in a rearward direction to a rearmost end of the tip; and one or more fracture regions defined in the tip retention portion, the one or more fracture regions configured to, when the tip is mounted in an expanding projectile, fracture or deform upon impact with a target and expose one or more fluid pathways into an interior cavity of the expanding projectile.

15. The cartridge of claim 14, wherein the tip retention portion includes one or more recesses extending axially in the forward direction from a rear end of the tip retention portion to a recess end point.

16. The cartridge of claim 15, wherein the one or more recesses include an axially centered recess extending from the rear end of the tip retention portion to a recess end point within the interior of the tip.

17. The cartridge of claim 14, wherein the tip retention portion includes a shoulder portion and a neck portion connected to and between the main portion of the tip and the shoulder portion.

18. The cartridge of claim 14, wherein the fracture region is the neck portion.

19. A cartridge, comprising:

a casing comprising a rearward primer, a propellant, and a bullet, the bullet comprising: a bullet body including a boattail portion, a bearing portion, and an ogival portion;

the bearing portion comprising at least one circumferential groove comprising a forward wall portion, a bottom wall portion, and a rearward wall portion;

wherein the rearward wall portion comprises a ramp extending between the bottom wall portion and an exterior surface of the bearing portion of the bullet body comprising a forward facing lead-out angle in the range of 18° to 45° measured from a line on the exterior surface of the bearing portion parallel to a bullet axis;

wherein the forward wall portion extends between the bottom wall portion and an exterior surface of the bearing portion of the bullet body comprising a rearward facing lead-in angle, the lead-in angle being acute and greater than the forward facing angle of the ramp of the rearward wall portion as measured from a line on the exterior surface of the bearing portion parallel to a bullet axis; and wherein the bullet body comprises a metal jacket extending from a tail portion to a nose portion and surrounding an interior core.

20. The cartridge of claim 19, the nose portion further comprising a taper in a forward direction to an annular forward edge, the annular forward edge defining an opening in the metal jacket to an interior cavity extending from the opening in a rearward direction to a forward facing interior surface of the interior solid core, the cartridge further comprising a polymer tip mounted in the interior cavity, and the cartridge of further comprising the circumferential groove at a forward half of the bearing portion and a rearward half of the bullet body.

* * * * *